US010130137B2

(12) United States Patent
Edwards et al.

(10) Patent No.: US 10,130,137 B2
(45) Date of Patent: Nov. 20, 2018

(54) FLEXIBLE FOOTWEAR ARTICLE AND METHOD OF MANUFACTURE

(71) Applicants: D'Wayne Edwards, Beaverton, OR (US); Wichaya Chantarasamee, Aloha, OR (US)

(72) Inventors: D'Wayne Edwards, Beaverton, OR (US); Wichaya Chantarasamee, Aloha, OR (US)

( * ) Notice: Subject to any disclaimer, the term of this patent is extended or adjusted under 35 U.S.C. 154(b) by 96 days.

(21) Appl. No.: 15/217,748

(22) Filed: Jul. 22, 2016

(65) Prior Publication Data

US 2018/0020766 A1 Jan. 25, 2018

(51) Int. Cl.
*A43B 3/26* (2006.01)
*A43B 13/14* (2006.01)
*A43B 13/16* (2006.01)

(52) U.S. Cl.
CPC ..... *A43B 3/26* (2013.01); *A43B 13/141* (2013.01); *A43B 13/16* (2013.01)

(58) Field of Classification Search
CPC ..... A43B 3/0036; A43B 3/26; A43B 13/023; A43B 13/12; A43B 13/141
USPC ..... 36/102, 13, 25 R, 30 R, 31, 97
See application file for complete search history.

(56) References Cited

U.S. PATENT DOCUMENTS 2,126,077 A * 8/1938 Youngberg ..... A43B 13/08 36/11.5
4,059,910 A * 11/1977 Bryden ..... A43B 3/108 12/146 B
4,309,832 A * 1/1982 Hunt ..... A43B 7/142 36/102
RE33,018 E * 8/1989 Ostrander ..... A43B 3/108 36/102
4,944,099 A * 7/1990 Davis ..... A43B 3/26 36/102
5,384,973 A * 1/1995 Lyden ..... A43B 13/12 36/102
5,682,685 A * 11/1997 Terlizzi ..... A43B 5/12 36/102
6,138,385 A * 10/2000 Jungkind ..... A43B 1/0018 36/102
7,954,261 B2 * 6/2011 Shakoor ..... A43B 13/141 36/102
8,505,219 B2 * 8/2013 Avar ..... A43B 5/06 36/102
8,656,613 B2 * 2/2014 Stockbridge ..... A43B 13/00 36/102
8,752,307 B2 * 6/2014 Cooper ..... A43B 1/0072 36/102
9,402,438 B2 * 8/2016 Shakoor ..... A43B 3/0036
2002/0078591 A1 * 6/2002 Morrone ..... A43B 5/12 36/8.3
2004/0148804 A1 * 8/2004 Romano ..... A43B 3/00 36/103
2008/0216355 A1 * 9/2008 Becker ..... A43B 13/026 36/102

(Continued)

*Primary Examiner* — Marie Bays
(74) *Attorney, Agent, or Firm* — Klarquist Sparkman, LLP

(57) ABSTRACT

An article of footwear includes at least a first outsole member and a second outsole member, and at least one flex member secured to the first outsole member and the second outsole member and having sufficient flexibility to permit the first outsole member to move relative to the second outsole member to expand the article of footwear from a first size to a second, larger size.

13 Claims, 23 Drawing Sheets

(56) References Cited

U.S. PATENT DOCUMENTS

| | | | | |
|---|---|---|---|---|
| 2009/0044432 | A1* | 2/2009 | O'Connor | A43B 3/0057 36/30 R |
| 2009/0307929 | A1* | 12/2009 | Tvoua | A43B 3/108 36/97 |
| 2010/0186257 | A1* | 7/2010 | Karl | A43B 5/12 36/44 |
| 2013/0152428 | A1* | 6/2013 | Bishop | A43B 13/16 36/103 |
| 2013/0212905 | A1* | 8/2013 | Hazenberg | A43B 13/122 36/28 |
| 2014/0013623 | A1* | 1/2014 | James | A43B 13/141 36/102 |
| 2014/0373396 | A1* | 12/2014 | Chang | A43B 3/122 36/30 R |
| 2015/0089841 | A1* | 4/2015 | Smaldone | A43B 5/00 36/103 |
| 2015/0143722 | A1* | 5/2015 | Faggin | A43B 3/108 36/25 R |
| 2017/0280822 | A1* | 10/2017 | Langvin | A43B 13/141 |

* cited by examiner

FLEXIBLE FOOTWEAR ARTICLE AND METHOD OF MANUFACTURE

FIELD

The present disclosure is directed to articles of footwear and their methods of manufacture, and, in particular, to footwear that provides flexibility and/or adjustability in sizing.

BACKGROUND

Footwear is typically produced in a number of different shoe sizes, each of which fits a particular size of foot. Although units of measurement vary worldwide, the various sizes in each system are intended to account for a different foot size in the population of wearers, which can include men, woman, and children. In the United States, for example, typical adult shoe sizes vary in length from sizes 4-15, with half sizes available in between most of these sizes. In many cases, different widths are also available (e.g., D, E, EE, etc.) in these shoe sizes to accommodate feet of different widths. Thus, because of the large variation in foot sizes, stores that stock articles of footwear must carry large numbers of different sizes.

In addition, a person's foot size will change over time. For example, changes in foot size can result from age-related periods of foot growth, external temperature changes in the environment, physiological changes in the body such as those caused by pregnancy, injury, or other medical conditions that result in an increase or decrease in the overall size and shape of one's feet.

Thus, it would be desirable to provide an article of footwear that reduces the number of sizes required to meet the needs of an intended population of wearers and/or that can accommodate some variation in foot size among individual users without discomfit.

SUMMARY

The novel articles of footwear described herein are expandable from a first, relaxed configuration to second, expanded configuration to accommodate a larger foot (in length, in width, or in both length and width).

In one embodiment, an article of footwear is provided that includes at least a first and second outsole members having respective upper surfaces, perimeter surfaces, inner surfaces. At least one flex member is secured to the first outsole member and the second outsole member. The at least one flex member has sufficient flexibility to permit the first outsole member to move relative to the second outsole member. In other embodiments, the article can include addition outsole members that collectively define the outsole.

In another embodiment, a method of forming an article of footwear is provided. The method can include forming at least two outsole members (with each outsole member comprising a top surface, an inner surface, and a perimeter surface) and positioning the at least two outsole members such that respective inner surfaces face each other and the respective perimeter surfaces collectively define a perimeter of the article. The at least two outsole members can be flexibly coupled together such that the article can expand from a relaxed configuration to an expanded configuration, wherein in the expanded configuration the inner surfaces of adjacent outsole members are further apart than in the relaxed configuration.

The foregoing and other features and advantages of the invention will become more apparent from the following detailed description, which proceeds with reference to the accompanying figures.

DETAILED DESCRIPTION

Figure 1:
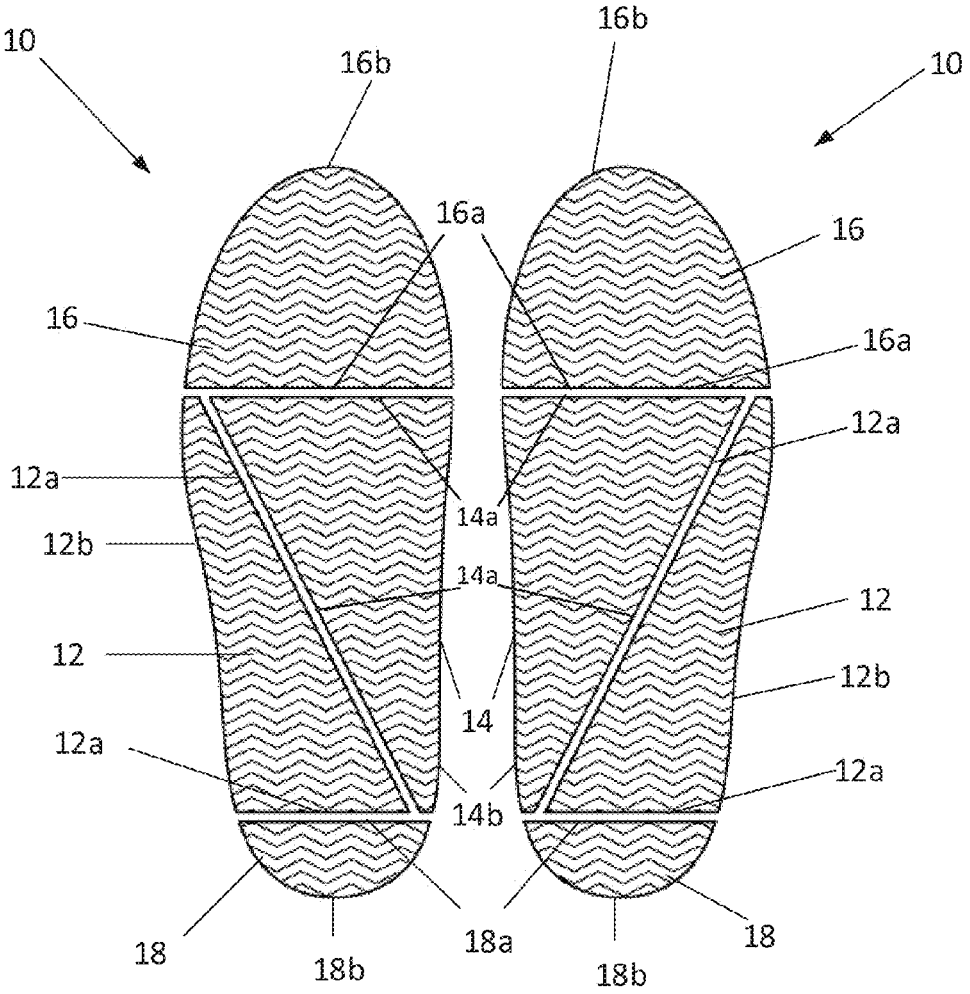
FIG. 1 is a bottom view of a pair of outsoles that include at least two outsole members.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "determine" and "provide" to describe the disclosed methods. These terms are high-level abstractions of the actual operations that are performed. The actual operations that correspond to these terms may vary depending on the particular implementation and are readily discernible by one of ordinary skill in the art.

Articles of footwear and methods of making such footwear are disclosed herein. Unless otherwise specified herein, other terms used herein should be given their plain meanings as they are understood by the footwear industry.

As used herein, the terms "forefoot region" generally relates to portions of an article of footwear that correspond to the location of toes (phalanges), "midfoot region" generally relates to portions of an article of footwear that correspond to the middle part of the foot (e.g., generally including the arch of the foot), and "heel region" generally relates to portions of an article of footwear that correspond to the rear part of the foot (e.g., generally including the heel or calcaneus bone).

As used herein, the term "lateral side" refers to an outer side of a respective foot and the term "medial side" refers to the inner side of the foot (i.e., the side closest to the other foot). As used herein, the term "outsole" refers to the portion of an article of footwear that comes into direct contact with the ground. The outsole can be formed of various materials, such as rubber, thermoset polyurethane (TPU), polyurethane (PU), thermoplastic rubber (TPR), ethylene vinyl acetate (EVA), molded EVA, leather, synthetic leather, wood, cork, silicon, or any other natural (e.g., rice, bark, husks, plant based, shells, or nuts) or synthetic material.

In some cases, the article of footwear can include one or more side walls that extend upward, in full or in part, along the perimeter of the outsole. Side walls of the article can be formed separately from or integrally with other portions of the article, such as the outsole. The term "upper" refers to the part of an article of footwear that extends over, all or a part of, one or more of the toes, top of the foot, and back of the heel. In some cases, the upper can be attached to the outsole of an article of footwear. The upper can be formed of various materials, such as natural fibers (textile, cotton, bamboo, hemp, jute), man-made fibers (textile, polyester, microfiber, composite, spandex, lycra), polymers (rubbers, closed-cell rubber, polyurethane, nylon), leather (calf, goat, pig, fish, snake, exotics), or 3D printable materials (e.g., PLA, nylon, polymers, ABS, cellulose).

Figure 2:
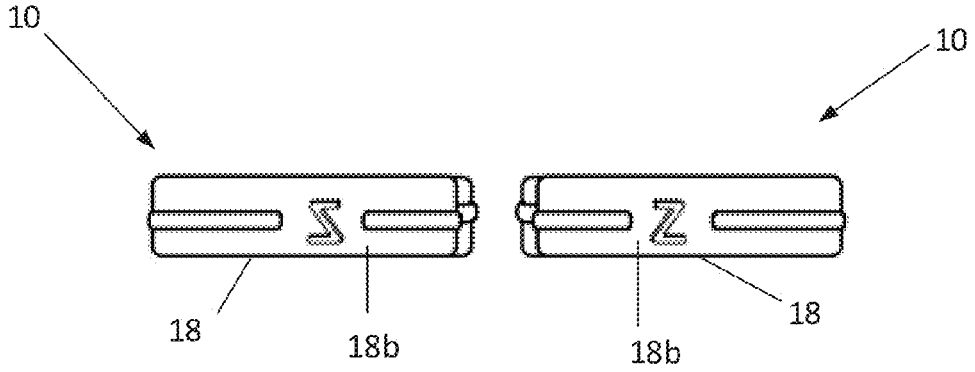
FIG. 2 is a back view of the pair of outsoles shown in FIG. 1.

FIG. 1 illustrates a bottom view of a pair of outsoles 10 that include at least two outsole members. In this embodiment, each outsole 10 has four separate outsole members 12, 14, 16, 18. Outsole members 12, 14, 16, 18 have respective inner surfaces 12*a*, 14*a*, 16*a*, 18*a*, and perimeter surfaces 12*b*, 14*b*, 16*b*, 18*b*. The inner surface of a respective outsole member face at least one inner surface of an adjacent outsole members, while the perimeter surface of a respective outsole member is a surface at the perimeter of the respective outsole 10. FIG. 2 illustrates a back view, which reflects only a portion of the perimeter surface 18*b* on both outsole members 10.

Figure 3:
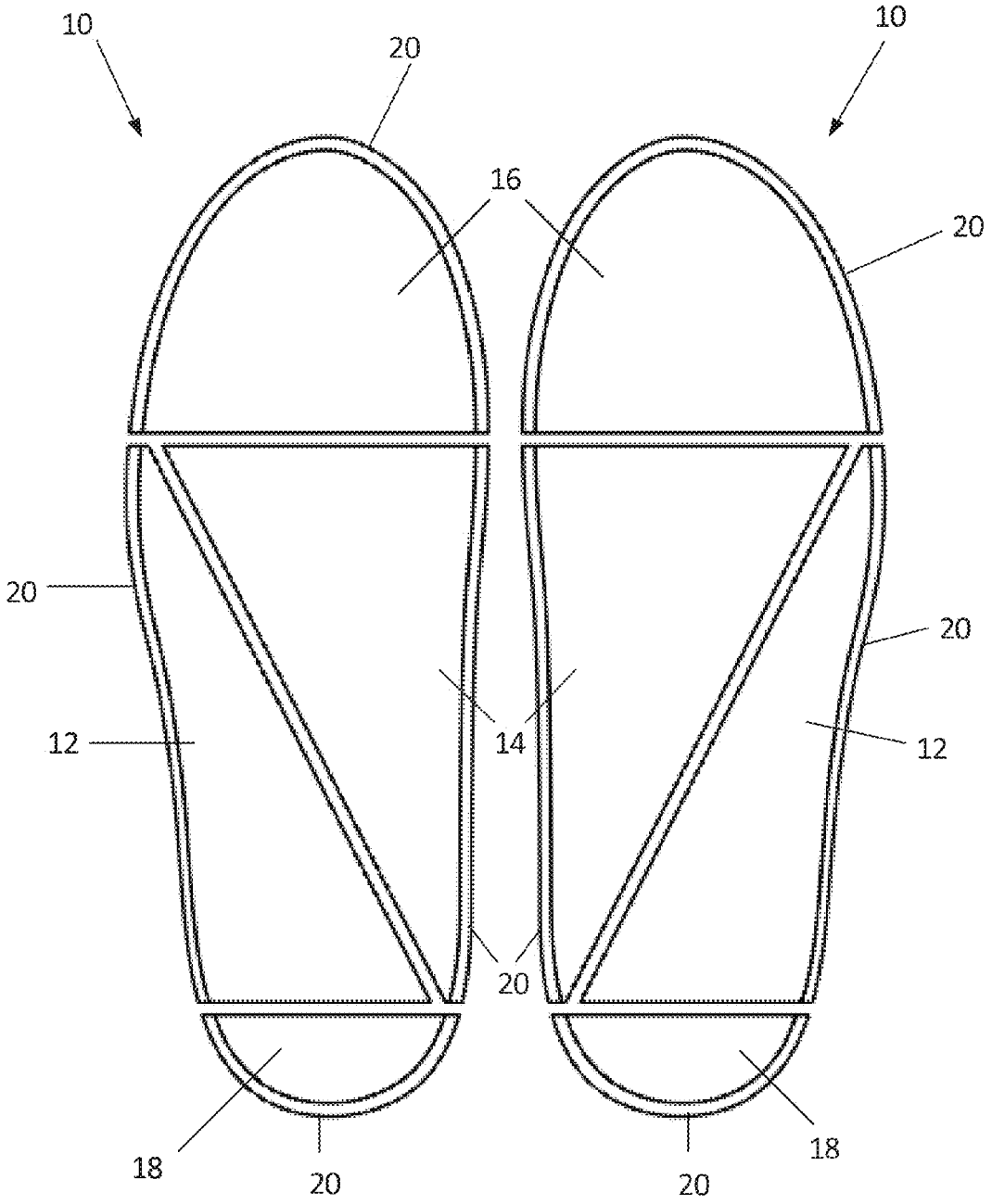
FIG. 3 is a top view of the pair of outsoles shown in FIG. 1.

FIG. 3 illustrates a top view of the pair of outsoles 10. As shown in FIG. 3 (and also, for example, FIG. 10), in some embodiments side walls 20 can be provided that extend upwardly along the perimeter of outsoles 10. Side walls 20 can be formed integrally with outsoles 10 (e.g., as part of the same mold), or separately formed and then coupled to respective outsoles 10 in any known manner.

Figure 4:
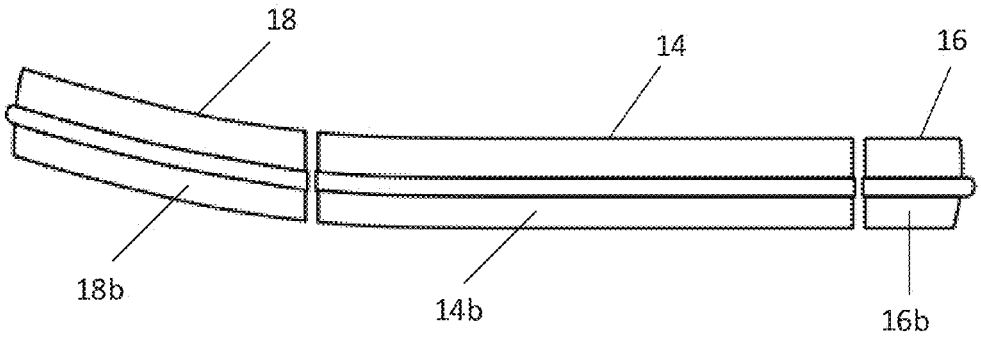
FIG. 4 is a medial view of an outsole shown in FIG. 1.
Figure 5:
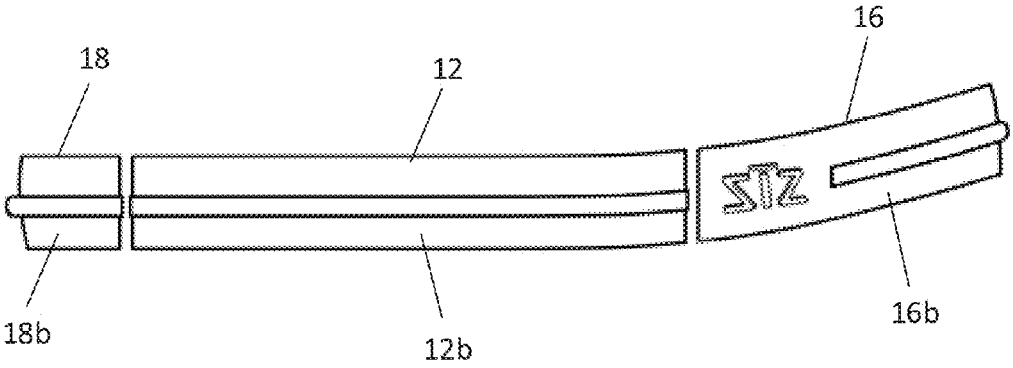
FIG. 5 is a lateral view of an outsole shown in FIG. 1.

FIGS. 4 and 5 illustrate medial and lateral views, respectively, of the right outsole 10. As shown in these figures, because outsole 10 has outsole members that have inner surfaces that diagonally extend across at least the midsole of the article, the two views reflect different outsole members—e.g., the medial view shows outsole member 14 and the lateral view shows outsole member 12.

One or more connecting members can be provided to couple different outsole members together. For example, one or more connecting members can be provided to flexibly secure one outsole member to another so that outsole members can move between (1) a relaxed configuration with adjacent outsole members abutting or closely facing one another and (2) an expanded configuration with adjacent outsole members positioned further apart than in the relaxed configuration.

In one embodiment, one or more flexible layers can be secured to portions of the upper surfaces of respective outsole members. The elasticity (or flexibility) of flexible layer allows an amount of relative movement to occur between two or more of the outsole members.

Figure 6:
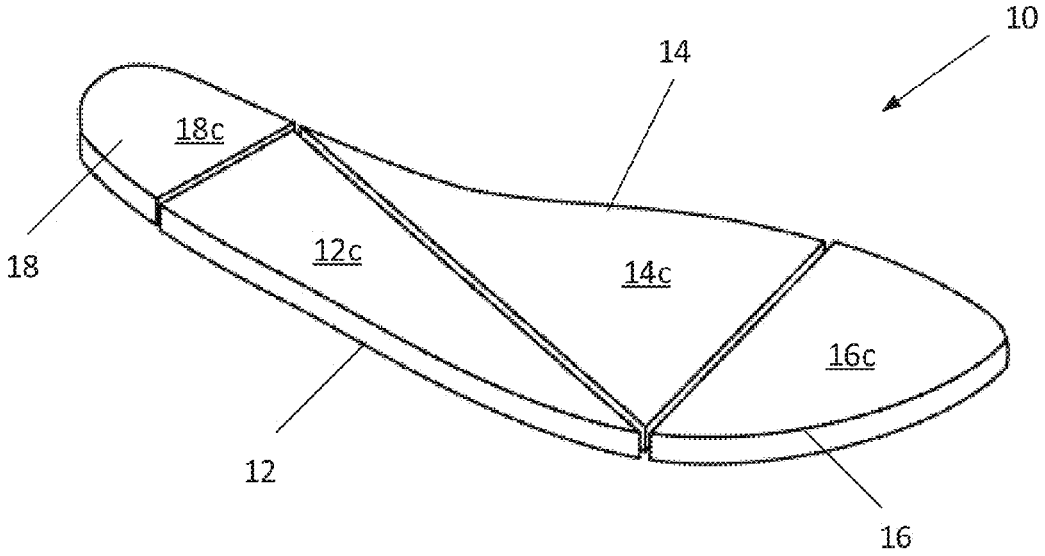
FIG. 6 illustrates the four outsole members of FIG. 1, shown without a connecting member(s).
Figure 7:
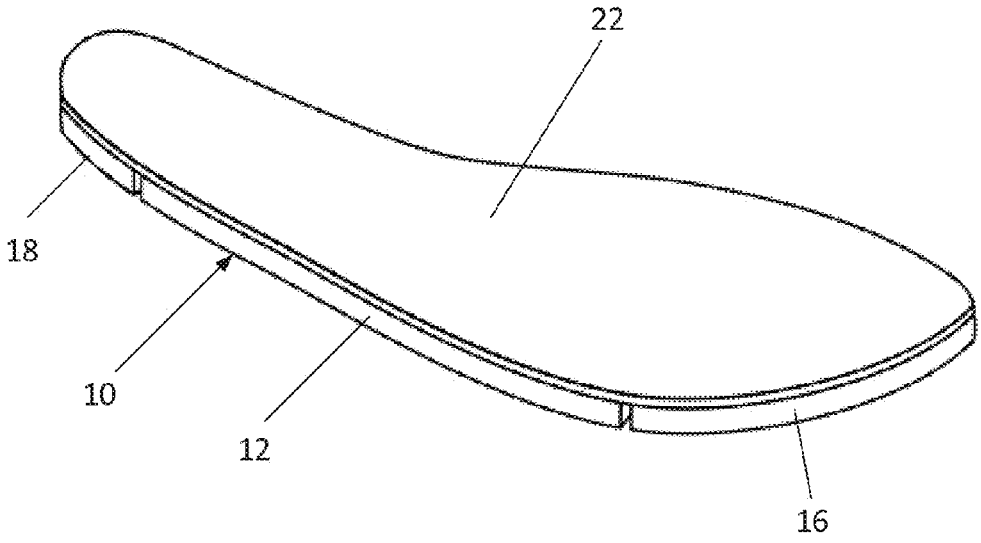
FIG. 7 illustrates a connecting member positioned over the outsole members shown in FIG. 6.

FIG. 6 illustrates the four outsole members 12, 14, 16, 18 without any connecting members, and FIG. 7 illustrates a connecting member 22 positioned over the outsole members and secured to respective upper surfaces of the outsole members. In the embodiment shown in FIG. 7, connecting member 22 comprises a single flexible layer that extends across respective upper surfaces 12*c*, 14*c*, 16*c*, 18*c* of the outsole members. As discussed above, however, the connecting member can include more than one flexible layer. For example, separate strips or other shapes of flexible layers can extend across the upper surfaces of at least two outsole members, with the separate strips or other shapes being coupled together in some other manner.

Connecting member 22 is secured to at least some portions of each of the upper surfaces 12*c*, 14*c*, 16*c*, 18*c*. For example, connecting member 22 can be secured to respective upper surfaces using an adhesive material that secures connecting member 22 to substantially all areas of the respective upper surfaces of the outsole member 10. Alternatively, connecting member 22 can be secured to only a portion of the respective upper surfaces, such as at the areas that are adjacent inner surfaces of respective outsole members.

When the connecting member is a flexible layer secured to the upper surfaces of the outsole members (e.g., as shown in FIG. 7), the flexible layer can comprise a synthetic stretch fabric or other suitable flexible material, such as any of those described herein. In some embodiments, the stretch fabric or flexible material can form, or can be included with, an insole of the article of footwear.

Figure 8A:
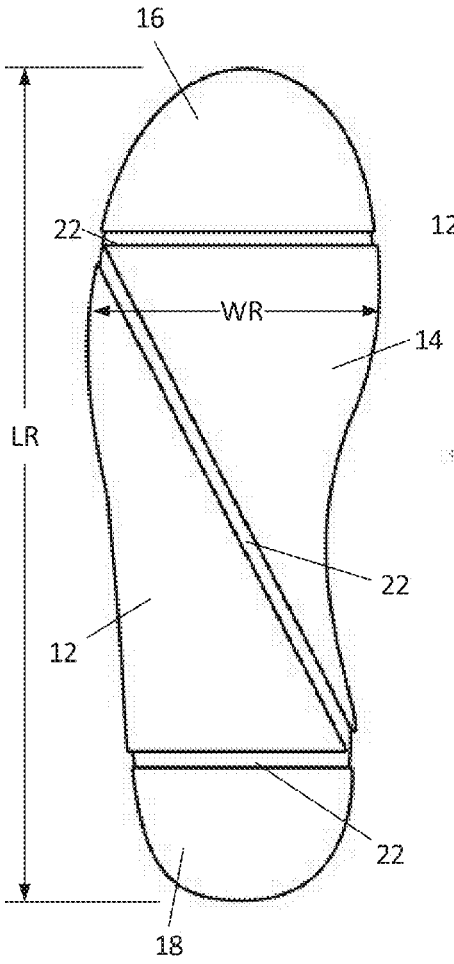
FIGS. 8A and 8B are bottom views of an article of footwear, with FIG. 8A showing a relaxed configuration with adjacent outsole members abutting or closely facing one another, and FIG. 8B showing an expanded configuration with adjacent outsole members positioned further apart than in the relaxed configuration.
Figure 8B:
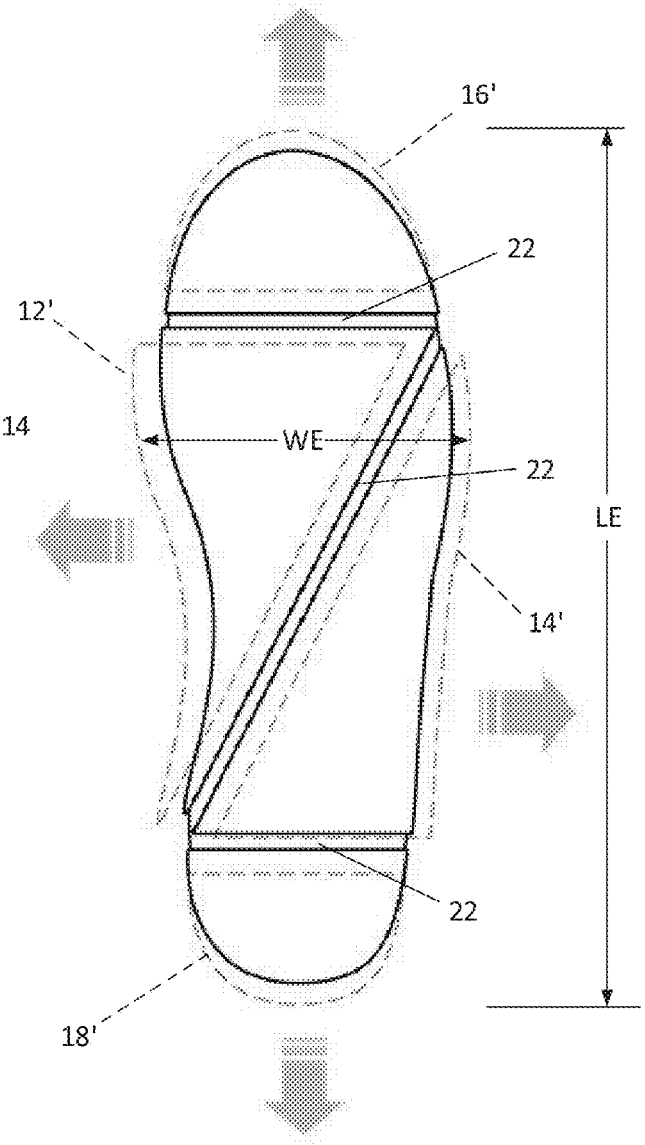

FIGS. 8A and 8B are bottom views that show the article of footwear. FIG. 8A shows the article of footwear in a relaxed configuration with adjacent outsole members (12, 14, 16, 18) abutting or closely facing one another, and FIG. 8B shows the article of footwear in an expanded configuration with adjacent outsole members (12', 14', 16', 18') positioned further apart than in the relaxed configuration. As shown in FIG. 8B, when a force is applied on the outsole members in the direction of the arrows, the outsole members can move apart into an expanded configuration such as that depicted by the dashed lines. In moving from a relaxed configuration to an expanded configuration, a gap between the inner surfaces of the outsole members is created, or increased if a gap is already present in the relaxed configuration. The movement of outsole members in the expanded configuration can increase the size of the article of footwear in length, width, or both length and width, depending on how the force is applied.

Two outsole members 12, 14 are generally located in the midfoot region of the shoe, and outsole members 16, 18 are located at the forefoot region and heel region, respectively. Referring again to FIG. 1, the outsole members 12, 14 that extend across the midfoot region each desirably has an inner surface 12*a*, 14*a* that extends laterally (i.e., between the medial and lateral sides of the article of footwear). The inner surfaces 12*a*, 14*a* also extend longitudinally (i.e., along the length of the shoe) from, for example, the heel region to the forefoot region. By providing at least some outsole members with inner surfaces that extend both laterally and longitudinally, the article of footwear can expand in both length and width, as shown, for example, in FIG. 8B.

As discussed above, connecting member 22 can be one or more flexible layers that extend across the upper surfaces of two or more outsole members. It is also possible to provide flexible layers that extend across lower surfaces of two or more outsole members; however, positioning the flexible layer on the upper surface is generally preferred to reduce wear on the flexible layer from contact with a ground surface when the article of footwear is in use.

In another embodiment, the connecting members 22 can comprise one or more flexible members that extend between adjacent outsole members (i.e., at the inner surfaces of adjacent outsole members). Such flexible members preferably have a greater flexibility than that of the outsole members (e.g., by being a different material and/or by altering the amount or shape of the material that extends between the inner surfaces). The greater flexibility of the flexible member permits relative movement between adjacent outsole members when a force is applied, while providing sufficient elasticity for the outsole members to move back into the relaxed configuration when the force is withdrawn.

If the connecting member is the same material as the outsole members, connecting members can have a greater relative flexibility by varying the shape and/or cross-sectional dimension of the material between adjacent surfaces of the outsole members. For example, a narrower section of material between the inner surfaces would allow for greater flexibility. Alternatively, different materials can be used for the connecting member(s) and outsole members, with the material of the connecting member having a greater flexibility than that of the outsole. When the connecting member is formed between adjacent surfaces of the outsole members, suitable materials for the connecting member can include those described above for use with the outsole or other suitable materials that can connect the two adjacent surfaces in the manner described herein.

The flexible material can be secured to adjacent inner surfaces of the outsole members. The flexible material can comprise various flexible materials, including, for example, polymers or fabrics. Such materials can be secured to the inner surfaces in any known manner, including, for example, tacks, staples, or adhesives. Alternatively, if the flexible material is a material that can be used in a mold, such material can be formed integrally with the inner surfaces of the outsole by injection molding both materials together in the same mold.

In some embodiments, the flexible materials (e.g., flexible layers secured to the upper surfaces, connecting members between adjacent surfaces) provided herein provide elasticity that allow for the material to stretch between 2-5 times its original (i.e., relaxed or unstretched) length, or in other embodiments, 2-3 times its original (i.e., relaxed or unstretched) length along at least one direction. Thus, if, in the relaxed condition, the flexible material provides a gap of 0.1 inches between adjacent inner surfaces of the outsole member, it can preferably stretch to a gap of 0.5 inches (or 0.3 inches) and, when relaxed return to substantially (i.e., +/−5%) the same original gap of 0.1 inches.

The bottom views shown in FIGS. 8A and 8B illustrates one or more connecting members 22 that are either (1) a flexible layer extending across upper surfaces as shown in FIG. 7, or (2) one or more flexible members that extend between inner surfaces of adjacent outsole members. Because these views are of the bottom of the article of footwear, both embodiments look substantially the same from this view.

Figure 9:
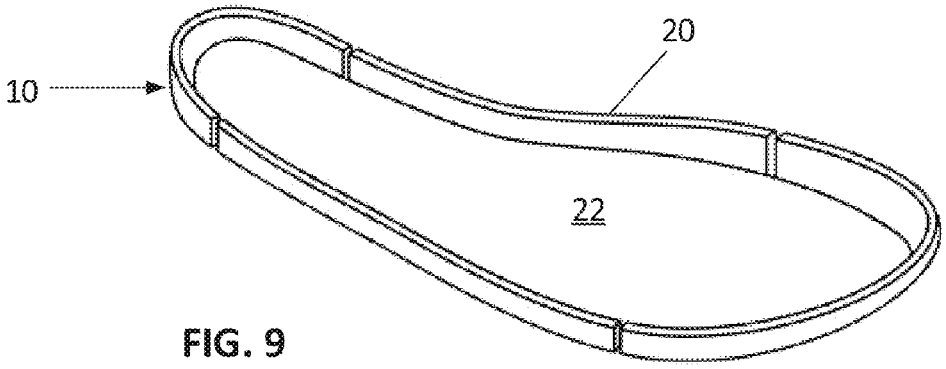
FIG. 9 shows a top view of an article of footwear with a plurality of outsole members, side walls, and a connecting member.
Figure 10:
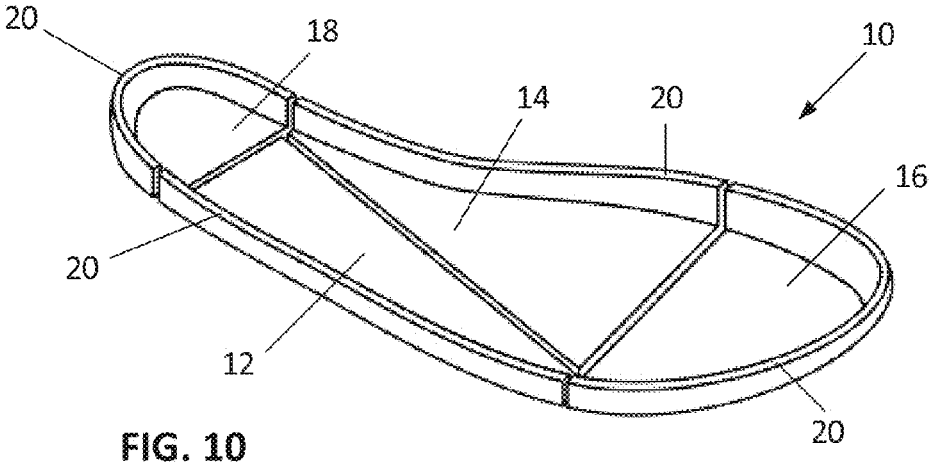
FIG. 10 shows a top view of the article of FIG. 9 with the connecting member removed and the outsole in a relaxed configuration.
Figure 11:
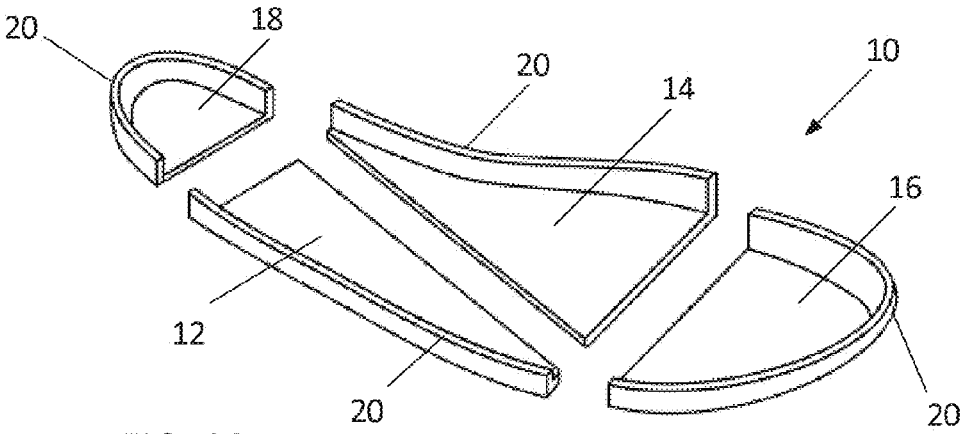
FIG. 11 shows a top view of the article of FIG. 9 with the connecting member removed and the outsole in an expanded configuration.

FIGS. 9-11 show various top views of an outsole 10 that comprises a plurality of outsole members 12, 14, 16, 18 with side walls 20 extending upward from perimeters of the outsole 10. Side walls 20 can be integrally formed with respective outsole members or separately coupled to them.

FIG. 9 illustrates the outsole 10 with a connecting member 22 that is a flexible layer. The flexible layer extends across upper surfaces of the outsole members in the manner discussed above. FIGS. 10 and 11 show the outsole members in the relaxed configuration and the expanded configuration, respectively. For clarity, FIGS. 10 and 11 illustrates the outsole members in these configurations without the connecting member.

Figure 12:
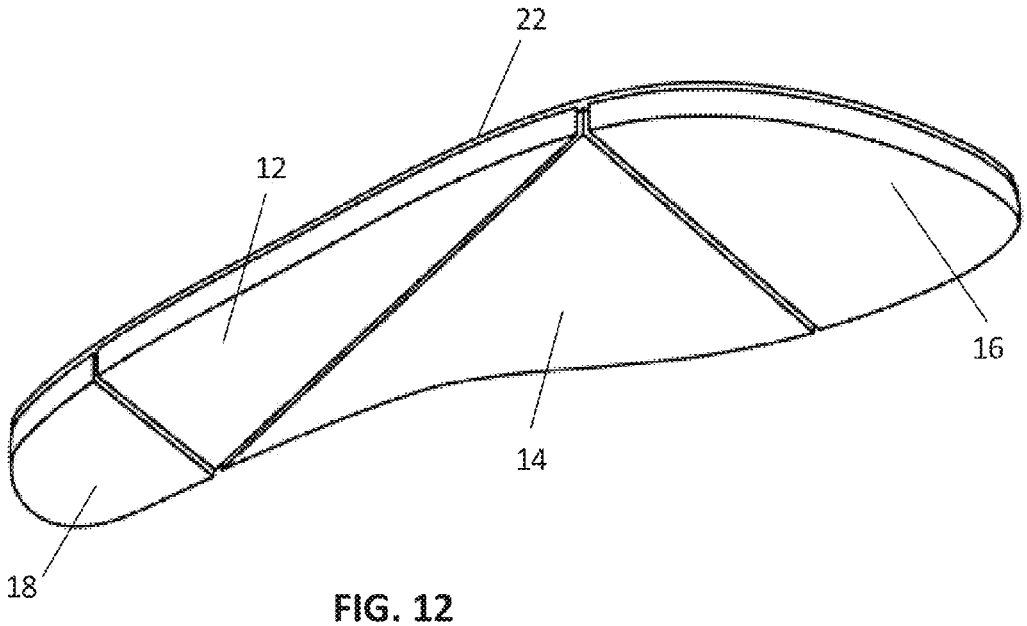
FIG. 12 shows a bottom view of an article of footwear with four outsole members and a connecting member in a relaxed configuration.
Figure 13:
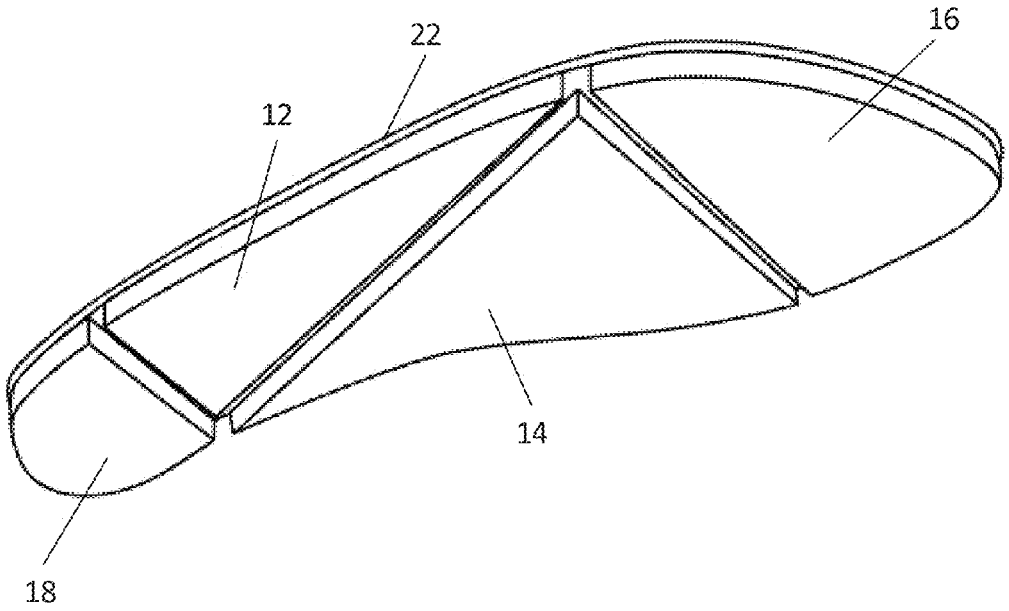
FIG. 13 shows a bottom view of the article of FIG. 12 in an expanded configuration.

FIGS. 12 and 13 show outsole 10 in similar relaxed and expanded configurations. The outsole 10 shown in these bottom views, however, differs from that shown in FIGS. 9-11 because there are no side walls formed with or attached to the outsole.

In each of the embodiments shown in FIGS. 1-13, a plurality of outsole members are provided that are separately moveable relative to one another. In the embodiments discussed above, four outsole members are provided and the inner surfaces of the four outsole members collectively define a z-shape. The terms z-shape or z-shaped, as used herein, refer to an outsole that has a shape formed by facing portions (i.e., inner surfaces) of respective outsole members. A z-shape is formed when two generally parallel facing portions are separated by diagonally-extending facing portions that extend between the two generally parallel elements, such that the diagonally-extending facing portions extend from a medial side of an outsole to a lateral side of the outside.

As discussed above, in other embodiments, different numbers of outsole members are possible (e.g., more or fewer than four). FIGS. 14-18 illustrate an embodiment in which there are two separate outsole members.

Figure 14:
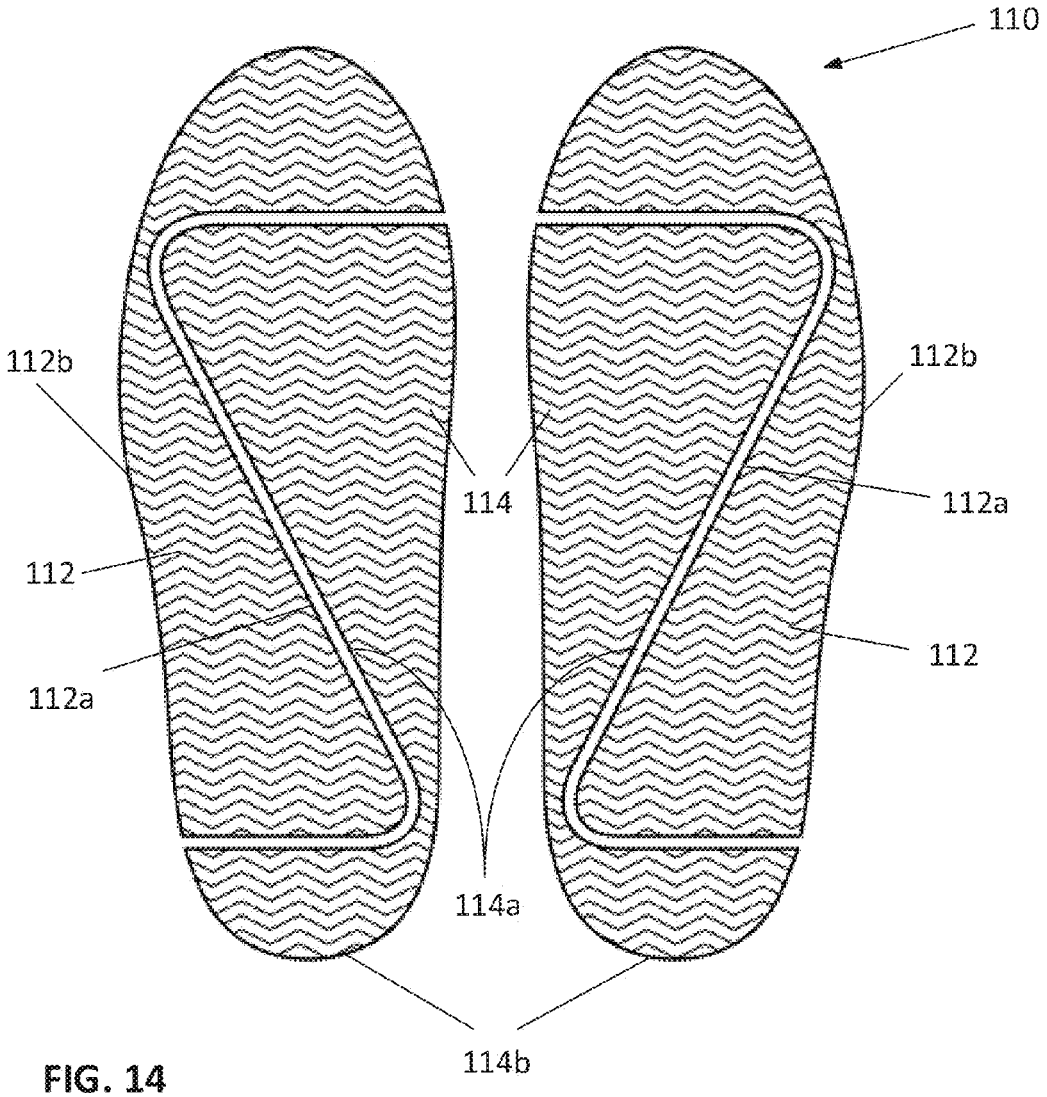
FIG. 14 illustrates a bottom view of an article of footwear with a pair of outsoles that each include two outsole members.
Figure 15:
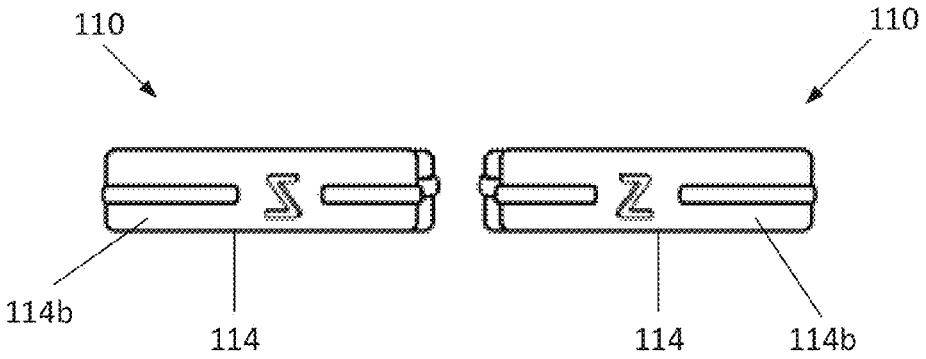
FIG. 15 is a back view of the pair of outsoles shown in FIG. 14.

FIG. 14 illustrates a bottom view of a pair of outsoles 110 that include two outsole members 112 and 114. In this embodiment, each outsole 110 has two separate outsole members 112, 114. Outsole members 112, 114 have respective inner surfaces 112*a*, 114*a* and perimeter surfaces 112*b*, 114*b*. In this embodiment, the inner surface 112*a* of outsole member 112 faces the inner surface 114*a* of the outsole member 114, while the perimeter surfaces of the two outsole members 112, 114 extend along, and generally define, the perimeter of outsole 110. FIG. 15 illustrates a back view, which reflects only a portion of the perimeter surface 114*b* on both outsole members 110.

As in the previous embodiments, the inner surfaces of the outsole members collectively define a z-shape; however, in this embodiment, the z-shape is rounded or curved at the area that the diagonal line meets the generally parallel lines.

As discussed above and as shown, for example, in FIG. 23, in some embodiments side walls 120 can be provided that extend upwardly along the perimeter of outsoles 110. Side walls 120 can be formed integrally with outsoles 110 (e.g., as part of the same mold), or separately formed and then coupled to respective outsoles 110 in any known manner.

Figure 16:
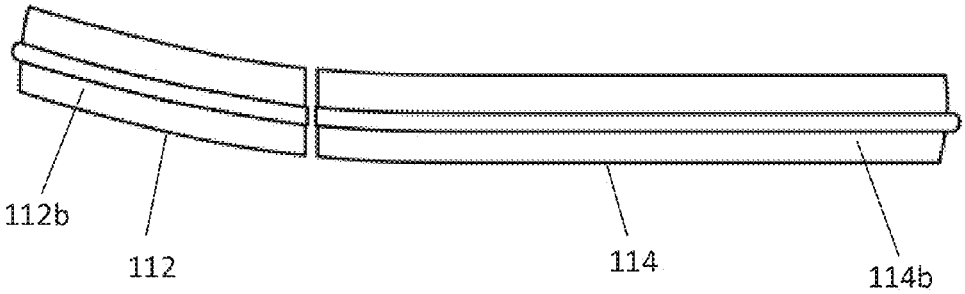
FIG. 16 is a medial view of an outsole shown in FIG. 14.
Figure 17:
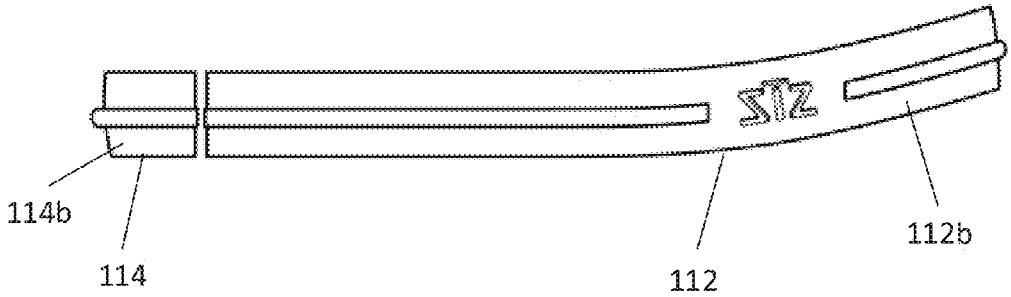
FIG. 17 is a lateral view of an outsole shown in FIG. 14.

FIGS. 16 and 17 illustrate medial and lateral views, respectively, of the right outsole 110. As shown in these figures, because outsole 110 has outsole members that have inner surfaces that extend diagonally across at least the midsole of the article, the two views reflect different outsole members—e.g., the medial view shows outsole member 114 and the lateral view shows outsole member 112.

Figure 18:
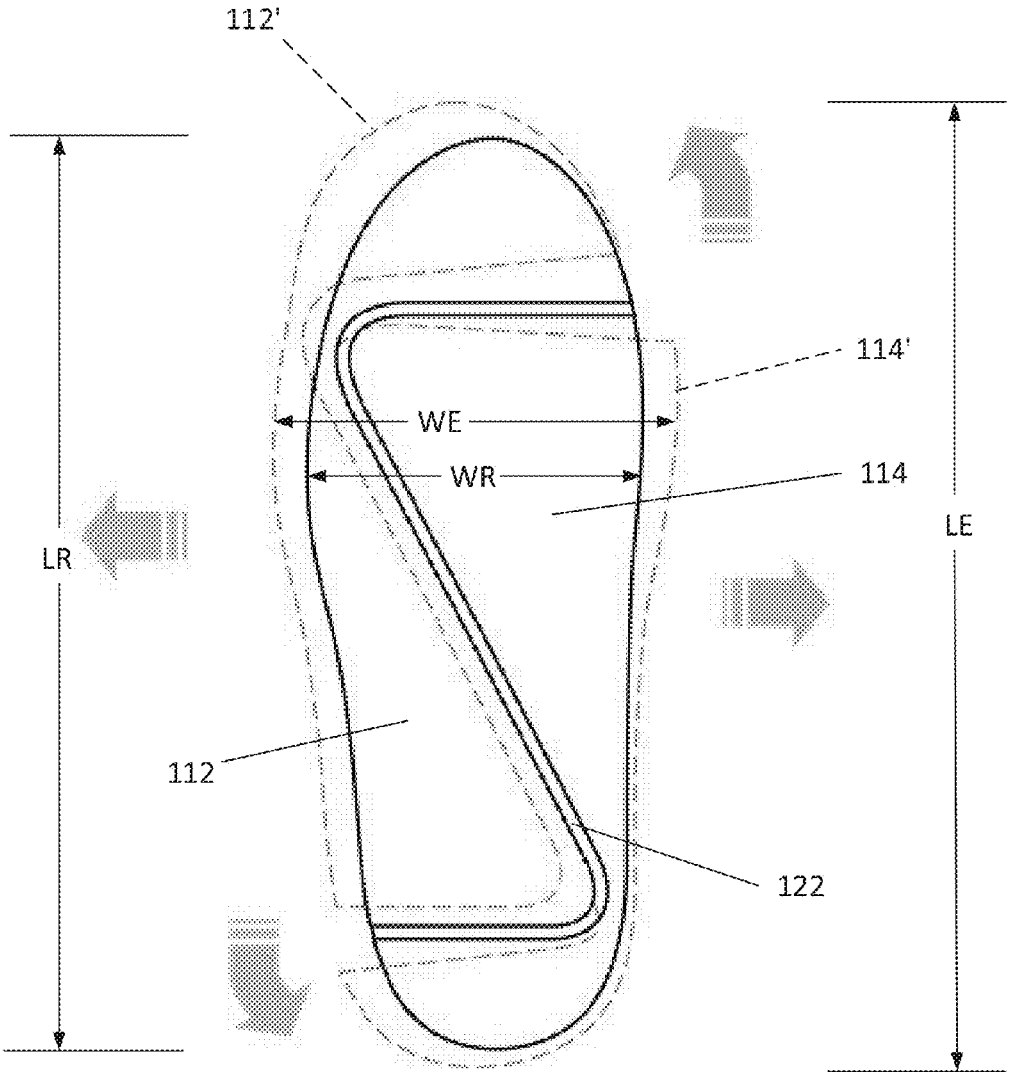
FIG. 18 is a bottom view of an article of footwear, showing relaxed and expanded configurations.

FIG. 18 shows the article of footwear in a relaxed configuration with adjacent outsole members (112, 114) abutting or closely facing one another, and the dashed lines shows the article of footwear in an expanded configuration with the same outsole members (112', 114') positioned further apart than in the relaxed configuration. As shown in FIG. 18, when a force is applied on the outsole members in the direction of the arrows, the outsole members can move apart into an expanded configuration such as that depicted by the dashed lines. In moving from a relaxed configuration to an expanded configuration, a gap between the inner surfaces of the outsole members is created, or increased if a gap is already present in the relaxed configuration. The movement of outsole members in the expanded configuration can increase the size of the article of footwear in length, width, or both length and width, depending on how the force is applied.

As in other embodiments discussed above, one or more connecting members 122 secure the outsole members together while allowing the outsole members to move relative to one another. For example, one or more flexible layers can extend across the upper surfaces of the two outsole members 112, 114, or one or more flexible members can extend between inner surfaces 112*a*, 114*a* of the outsole members. As in other embodiments, the connecting members have a greater flexibility than that of the outsole members (e.g., by being a different material and/or by altering the amount or shape of the material that extends between the inner surfaces), which permits relative movement between the outsole members 112, 114 when a force is applied, while providing sufficient elasticity for the two outsole members to move back to the relaxed configuration when the force is withdrawn.

Figure 19:
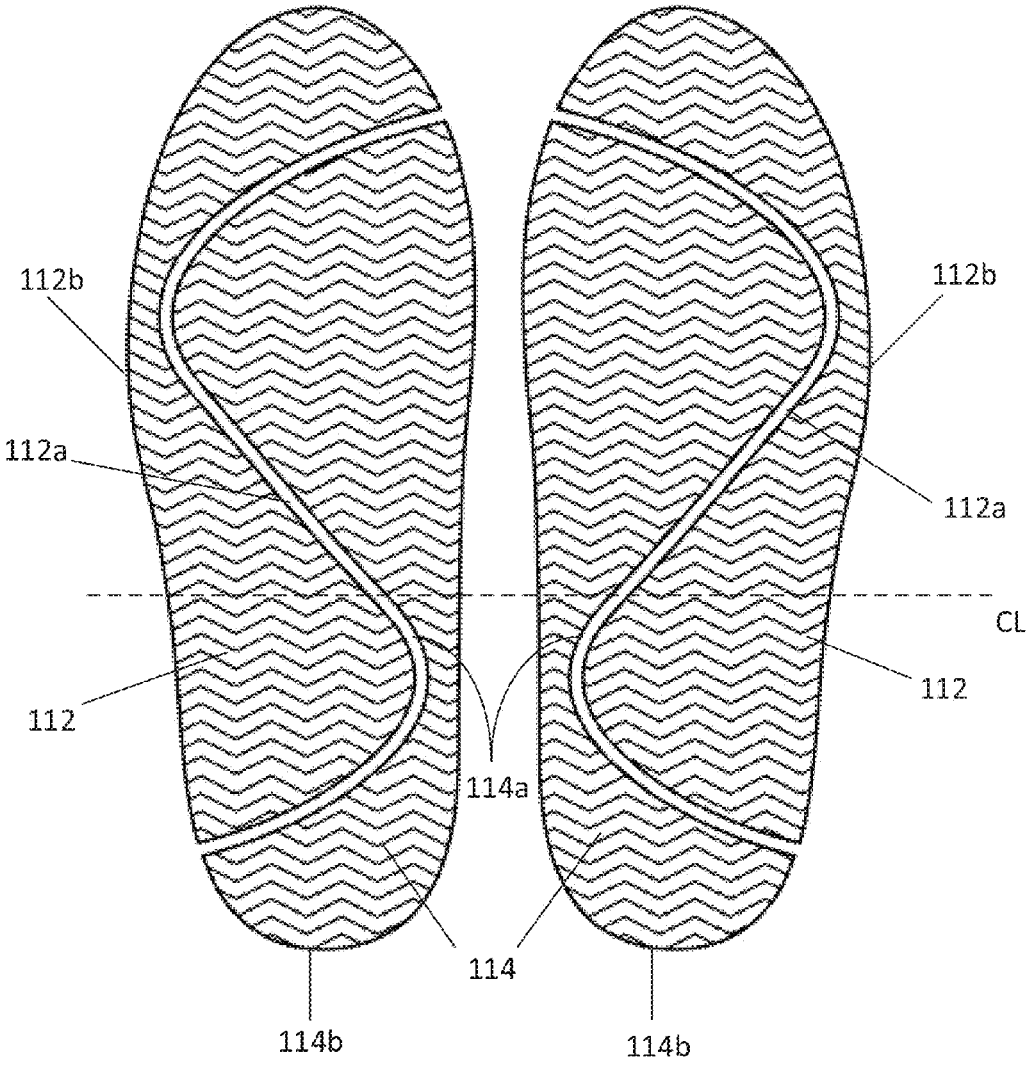
FIG. 19 illustrates a bottom view of another article of footwear with a pair of outsoles that each include two outsole members.

FIG. 19 is a bottom view of another embodiment of the two outsole members 112, 114. In this embodiment, the z-shape is curved similar to the manner shown in FIG. 18; however, the z-shape is also slightly off-set relative to an axis of the article of footwear. For example, the two generally parallel portions, while generally parallel to each other, are not parallel to a centerline CL of the article of footwear.

Figure 20:
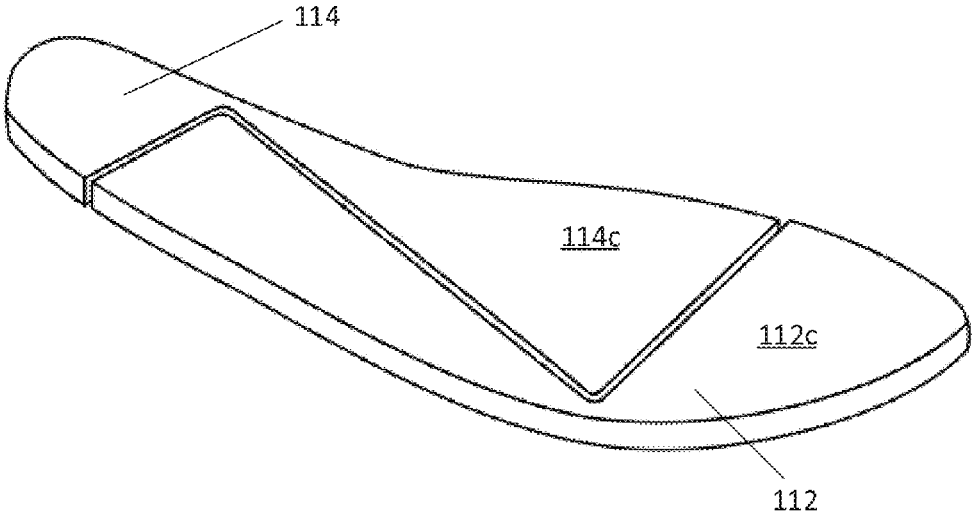
FIG. 20 illustrates the two outsole members shown in FIG. 19 without a connecting member(s).
Figure 21:
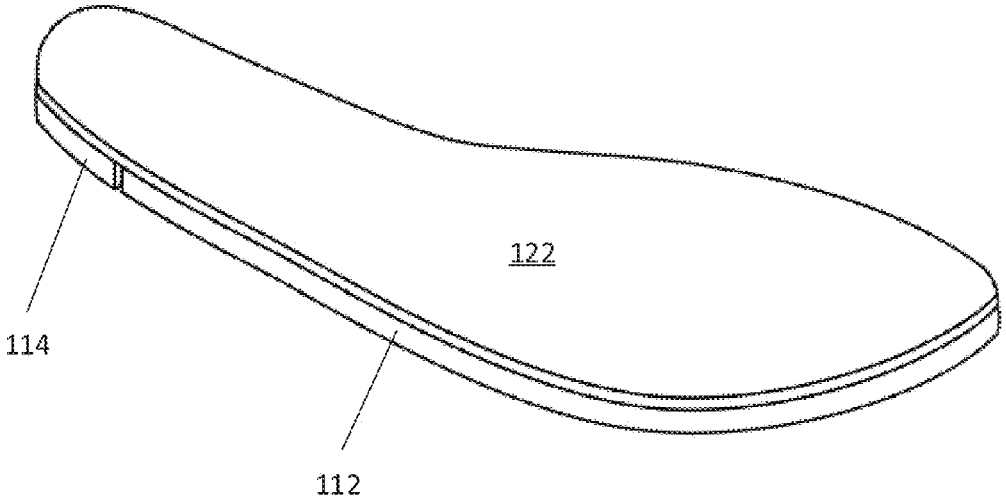
FIG. 21 illustrates a connecting member positioned over the outsole members shown in FIG. 20.

FIG. 20 illustrates the outsole members 112, 114 without any connecting members for clarity, and FIG. 21 illustrates a connecting member 122 positioned over the outsole members and secured to respective upper surfaces of the outsole members. In the embodiment shown in FIG. 22, connecting member 122 comprises a single flexible layer that extends across respective upper surfaces 112*c*, 114*c* of the outsole members 112, 114. As discussed above, however, the connecting member can include more than one flexible layer. For example, separate strips or other shapes of flexible layers can extend across the upper surfaces of at least two outsole members, with the separate strips or other shapes being coupled together in some other manner.

Figure 22:
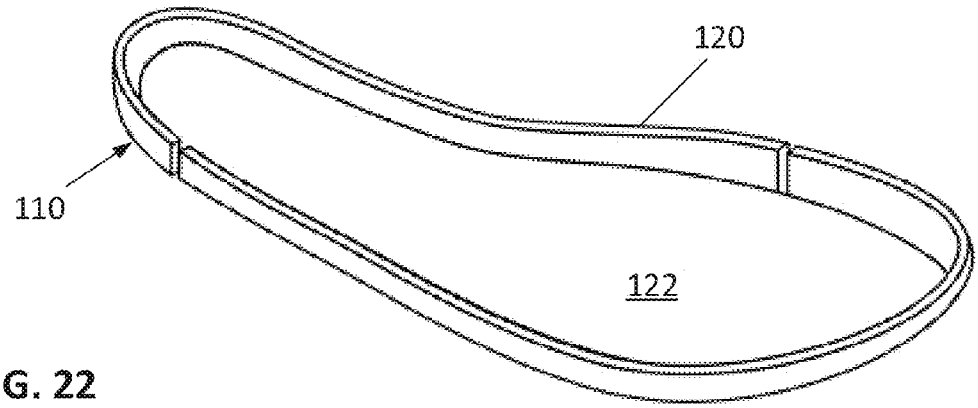
FIG. 22 shows a top view of an article of footwear with two outsole members, side walls, and a connecting member.
Figure 23:
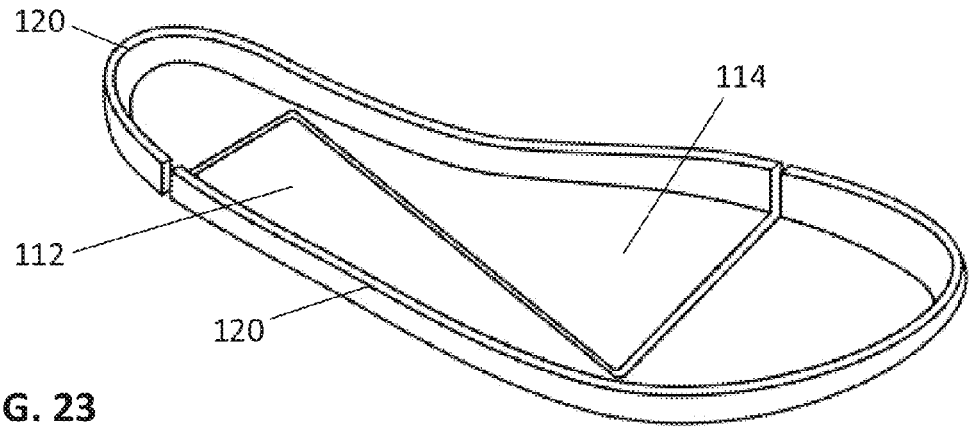
FIG. 23 shows a top view of the article of FIG. 22 with the connecting member removed and the outsole in a relaxed configuration.
Figure 24:
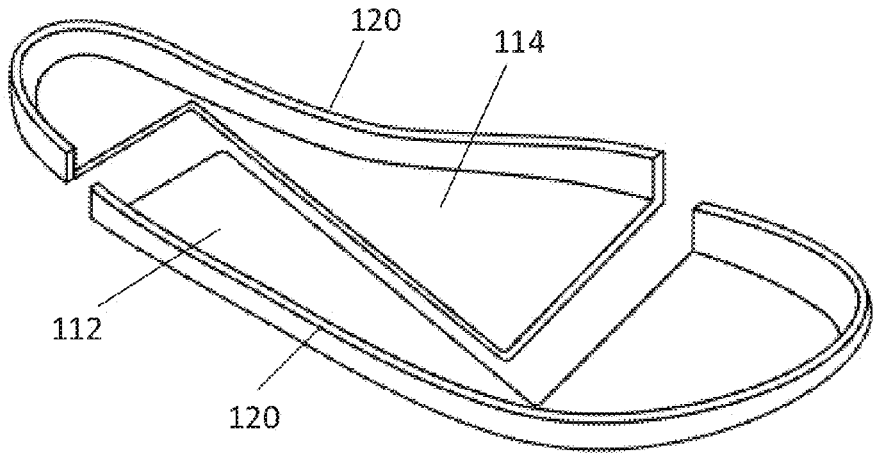
FIG. 24 shows a top view of the article of FIG. 22 with the connecting member removed and the outsole in an expanded configuration.

FIGS. 22-24 show various top views of outsole 110, showing outsole members 112, 114 with side walls 120 extending upward from perimeters of the outsole 110. As discussed above, side walls 120 can be integrally formed with respective outsole members or otherwise secured to the outsole members.

FIG. 22 illustrates the outsole 110 with a connecting member 122 that is a flexible layer. The flexible layer extends across upper surfaces of the outsole members in the manner discussed above. FIGS. 23 and 24 show the outsole members in the relaxed configuration and the expanded configuration, respectively. For clarity, FIGS. 23 and 24 illustrates the outsole members in these configurations without the connecting member.

Figure 25:
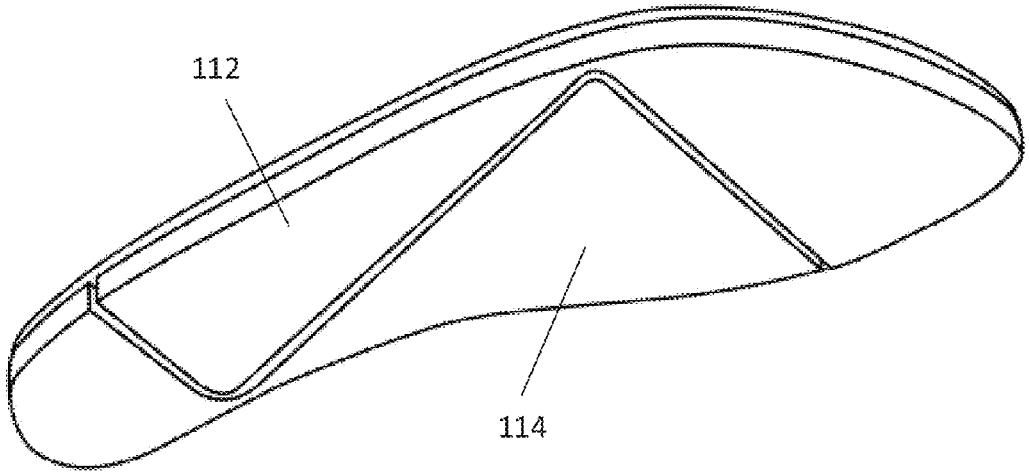
FIG. 25 shows a bottom view of an article of footwear with two outsole members and a connecting member in a relaxed configuration.
Figure 26:
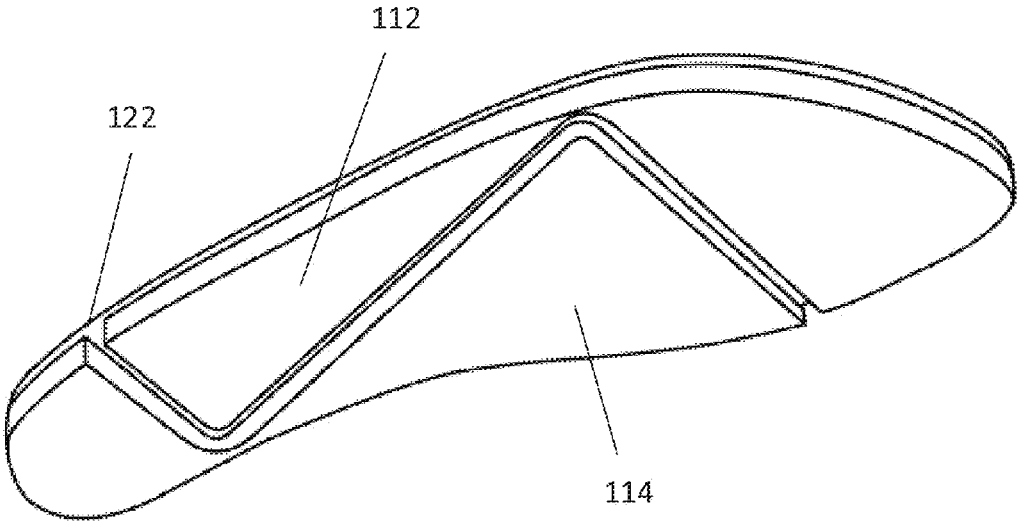
FIG. 26 shows a bottom view of the article of FIG. 25 in an expanded configuration.

FIGS. 25 and 26 show outsole 110 in similar relaxed and expanded configurations. The outsole 110 shown in these bottom views, however, differs from that shown in FIGS. 22-24 because there are no side walls formed with or attached to the outsole.

The connecting member, or plurality of connecting members, permit expansion of the article of footwear to accommodate different sizes of feet, either of different people or the same person as a result of swelling or other physiological changes. In a preferred embodiment, the connecting member (s) is flexible and permits a change in length from 2-25 percent of the overall length of the article (measured at the outsole). More preferably, the change in length can be between 5 and 15 percent of the overall length of the article, or even more preferably between 5 and 10 percent. For example, referring to FIGS. 8A and 8B, a length of the article changes from a relaxed length (LR) to an expanded length (LE). The expansion distance (i.e., LE-LR) is preferably 2-25 percent of the relaxed length (LR). Thus, as shown in Table 1 below, in one embodiment, if the LR of the article of footwear is 12.0 inches, the expanded length can vary between 12.24 inches and 15 inches (2-25%).

TABLE 1

| Percentage (LE/LR) | Length relaxed (LR) | Length expanded (LE) | Expansion amount (LE − LR) |
|---|---|---|---|
| 2% | 12 inches | 12.24 inches | 0.24 inches |
| 4% | 12 inches | 12.48 inches | 0.48 inches |
| 5% | 12 inches | 12.60 inches | 0.60 inches |
| 7% | 12 inches | 12.84 inches | 0.84 inches |
| 10% | 12 inches | 13.20 inches | 1.20 inches |
| 12% | 12 inches | 13.44 inches | 1.44 inches |
| 15% | 12 inches | 13.80 inches | 1.80 inches |
| 20% | 12 inches | 14.40 inches | 2.4 inches |
| 25% | 12 inches | 15.00 inches | 3.0 inches |

Articles of footwear, measured at the outsole, commonly vary from about 7 inches to 15 inches for men and women. Thus, for a 7 inch outsole, the article could vary in length, upon expansion, by 0.14-1.75 inches (2-25%), 0.35-1.05 inches (2-15%), or 0.35-0.7 inches (5-10%). For smaller articles of footwear, such as those made for children, the percentage variation would be the same. Thus, an outsole with a length of 5 inches can vary in length, upon expansion by 0.10-1.25 inches (2-25%), 0.10-0.75 inches (2-15%), or 0.25-0.5 inches (5-10%).

In some embodiments, the expansion in the length direction (i.e., LR to LE), the amount (or percentage) of expansion is greater than the amount (or percentage) of expansion in the width direction (i.e., WR to WE). In specific embodiments, the ratio of expansion in the length direction relative to the width direction is greater than 1.5:1 or, greater than 2:1.

Similarly, the articles of footwear described herein can vary in width in the same proportions. For example, as shown FIGS. 8A and 8B, an article of footwear can vary from a first width (WR, measured at the widest portion of the outsole when the article is in a relaxed configuration) to a second width (WE, measured at the widest portion of the outsole when the article is in an expanded configuration). In a preferred embodiment, the connecting member(s) is flexible and permits a change in width from 2-25 percent of the overall outsole width of the article. More preferably, the change in width can be between 5 and 15 percent of the overall width of the outsole, or even more preferably between 5 and 10 percent.

Figure 27:
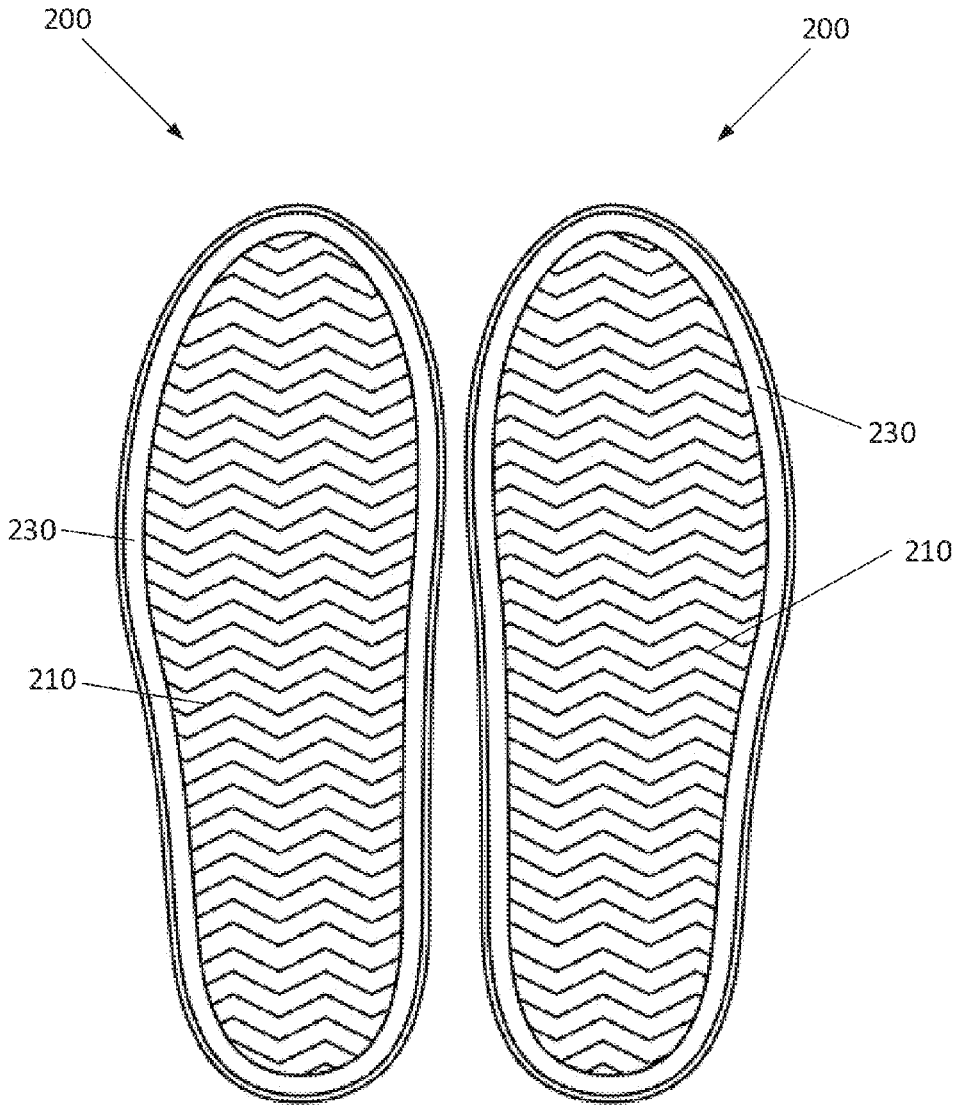
FIG. 27 shows a bottom view of an article of footwear with a flexible midsole member.

FIG. 27 illustrates another embodiment of an article of footwear 200 that, upon application of force, can move between a first, relaxed configuration and a second, expanded configuration. As shown in FIG. 27, the article 200 can comprise an outsole 210 and a flexible midsole member 230. Flexible midsole member 230 can comprise, for example, a stretchable fabric member secured, at least in part, to outsole 210.

Figure 28:
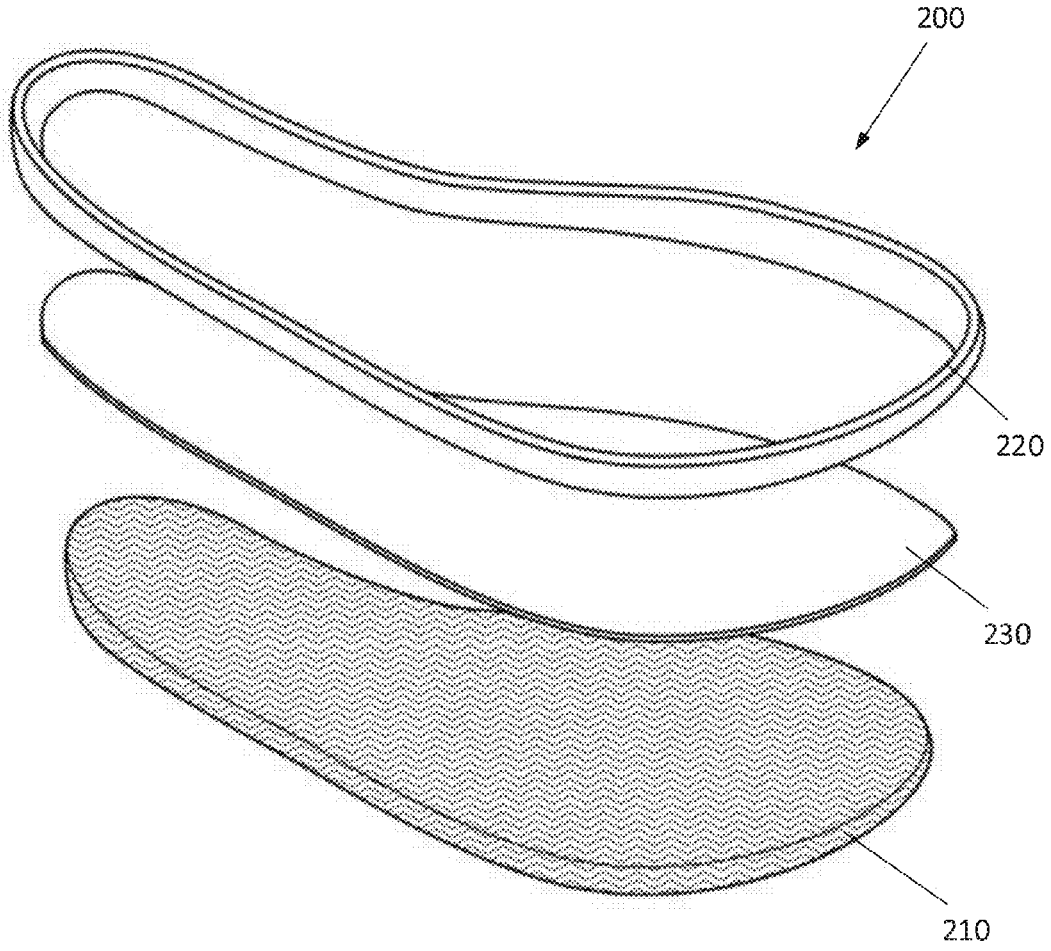
FIG. 28 shows an exploded view of the article of footwear shown in FIG. 27.
Figure 29:
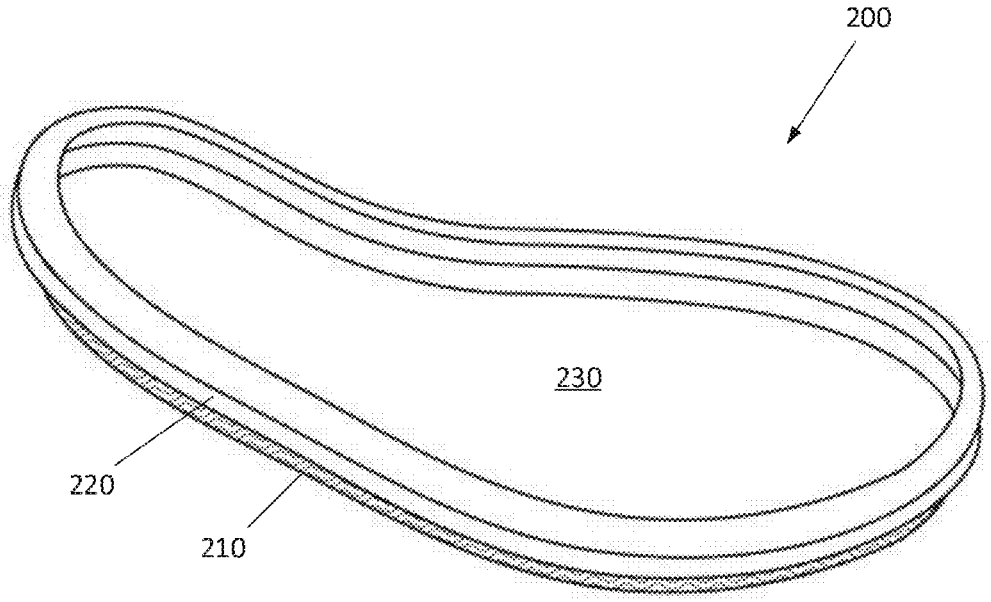
FIG. 29 shows a top perspective view of the article shown in FIG. 28 in a relaxed configuration.
Figure 30:
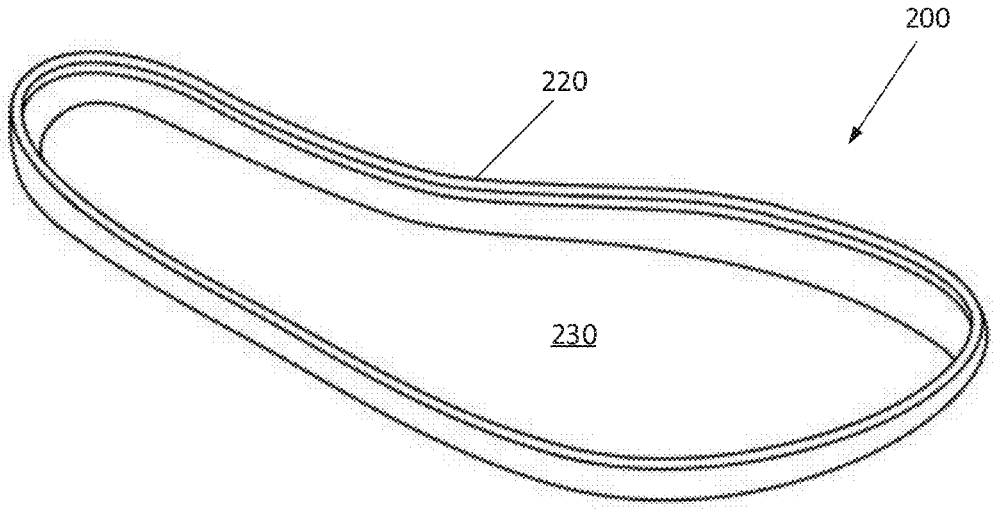
FIG. 30 shows a top perspective view of the article shown in FIG. 28 in an expanded configuration.

Referring to FIG. 28, article 200 can comprise outsole 210, flexible midsole member 230, and a flexible side wall 220 that generally surrounds and extends upwards from a perimeter of outsole 210. The combination of flexible midsole member 230 and flexible side wall 220 permit at least some portions of flexible midsole member and flexible side wall to expand, thereby allowing the article 200 to move between a relaxed configuration and an expanded configuration. FIG. 29 shows article 200 in the relaxed configuration, and FIG. 30 shows article 200 in an expanded configuration. In the expanded configuration, side walls 220 and flexible midsole member 230 move laterally outward. Thus, as shown in FIGS. 29 and 30, in the expanded configuration, at least a portion of side walls 220 and flexible midsole member 230 extend laterally beyond outsole 210.

Figure 31:
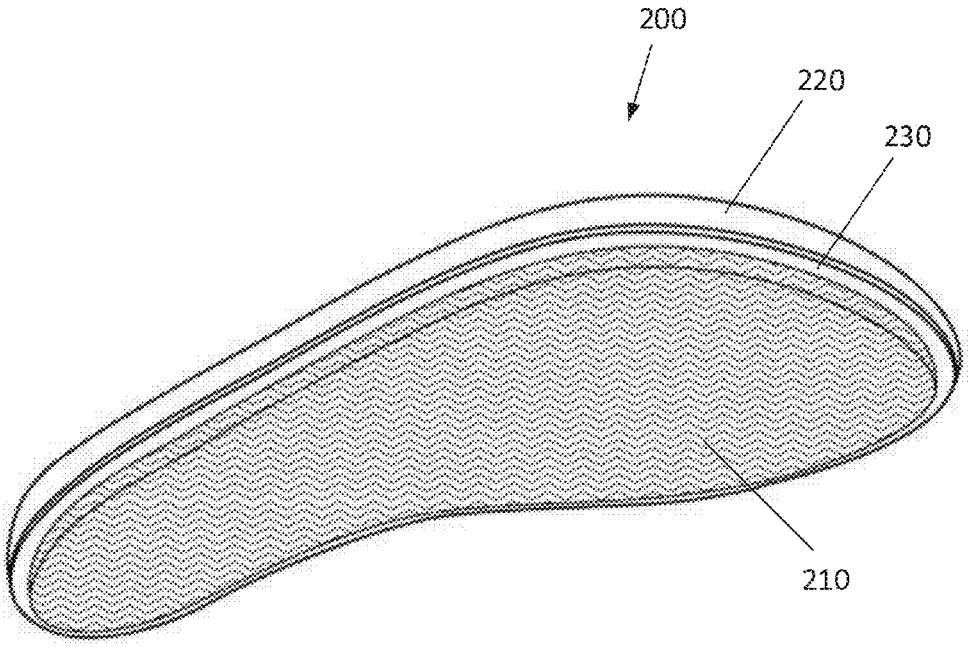
FIG. 31 shows a bottom perspective view of the article shown in FIG. 28 in a relaxed configuration.
Figure 32:
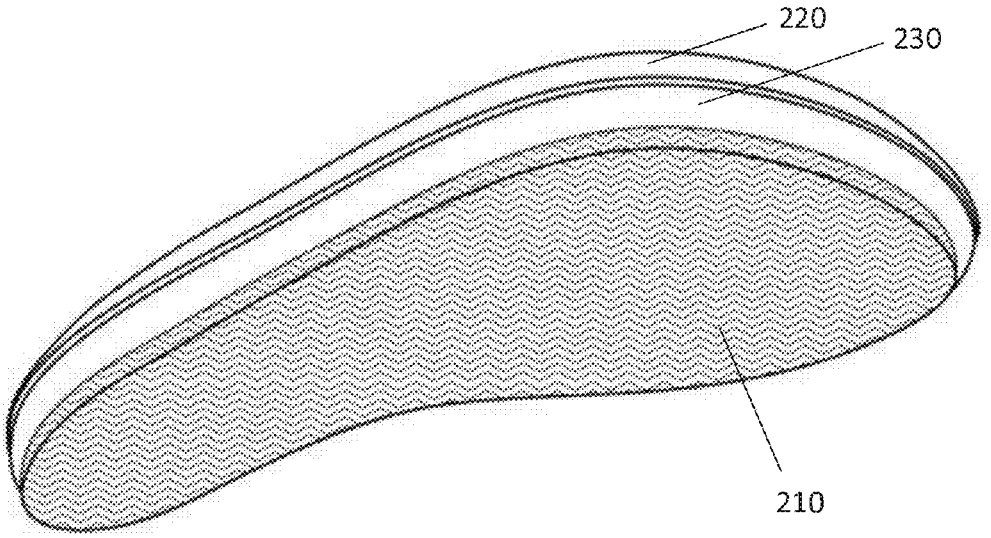
FIG. 32 shows a bottom perspective view of the article shown in FIG. 28 in an expanded configuration.

FIGS. 31 and 32 show bottom views of article 200 in the relaxed configuration and expanded configuration, respectively. As shown in FIG. 32, midsole member is stretched (causing it to increase in size from the size shown in FIG. 31) and overhangs laterally beyond outsole 210.

Figure 33:
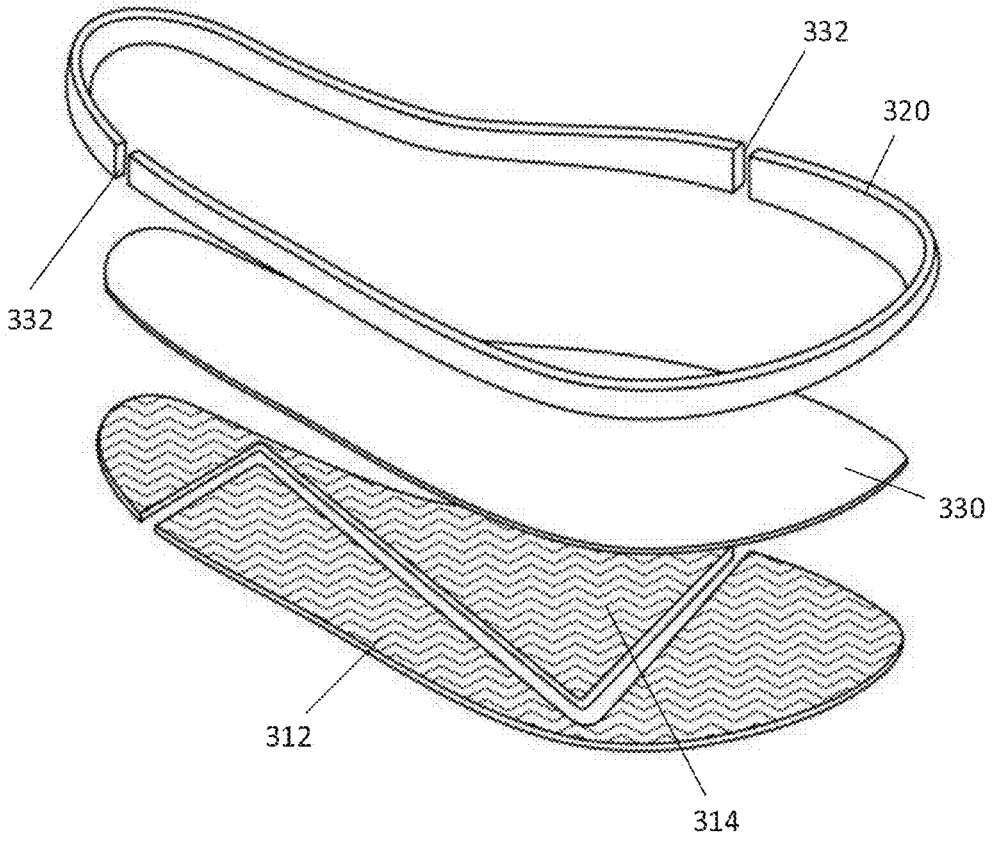
FIG. 33 shows an exploded view of another embodiment of an article of footwear that includes a plurality of outsole members and flexible midsole member.

FIG. 33 illustrates another embodiment of an article of footwear 300 that combines aspects of earlier embodiments, including a plurality of outsole members 312, 314, side walls 320, and flexible midsole member 330. In this arrangement, expansion of article 300 can be achieved by a combination of relative movement of outsole members 312, 314 and stretching of side walls 320 and midsole members 330. In some embodiments, including the embodiment shown in FIG. 33, side walls 320 can have one or more slits or cuts 332 (either completely or partially through the side wall) that permit greater flexibility in side walls upon application of lateral forces.

Figure 34:
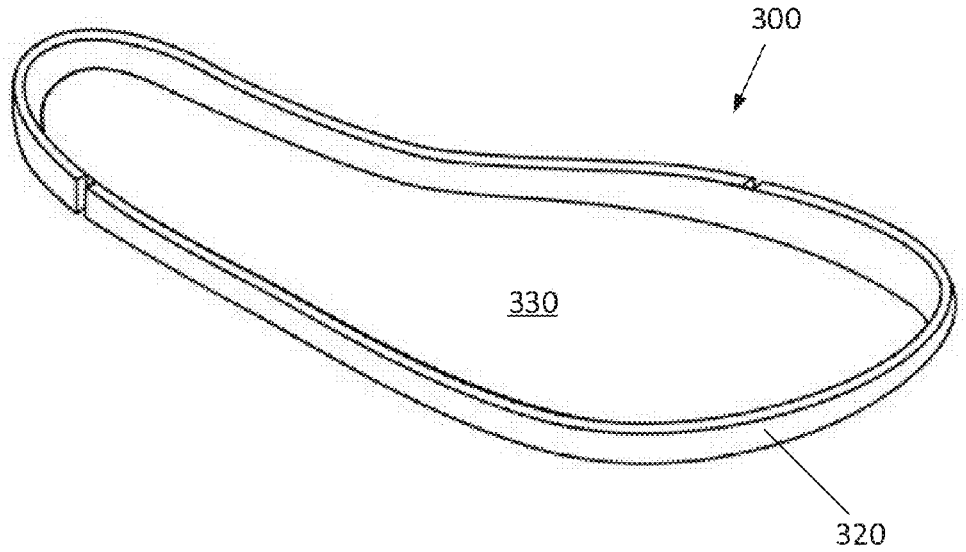
FIG. 34 illustrates a top view of the article shown in FIG. 33, without an outsole member.
Figure 35:
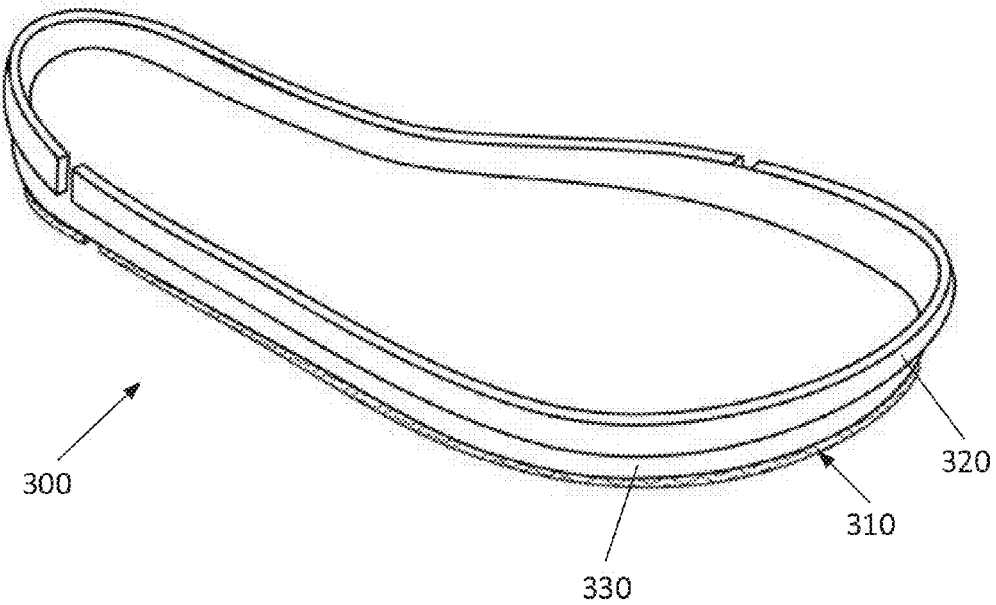
FIG. 35 shows the same view as FIG. 34, but with an outsole attached to the midsole member.

FIG. 34 illustrates a top view of article 300, showing the article in the relaxed configuration, while FIG. 35 shows the same view of article 300, when a force is applied causing the article to move into the expanded configuration.

Figure 36:
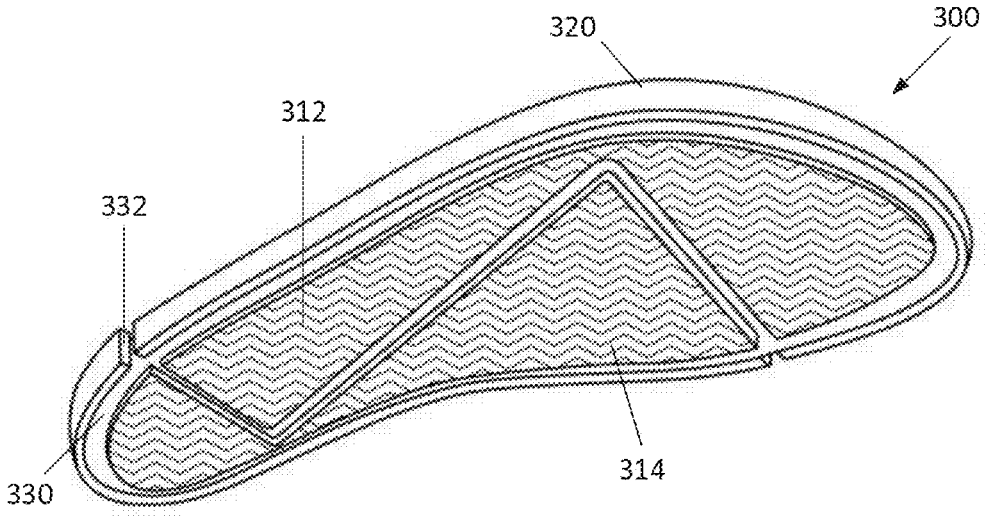
FIG. 36 is a bottom view of the article shown in FIG. 33, showing the article in a relaxed configuration.
Figure 37:
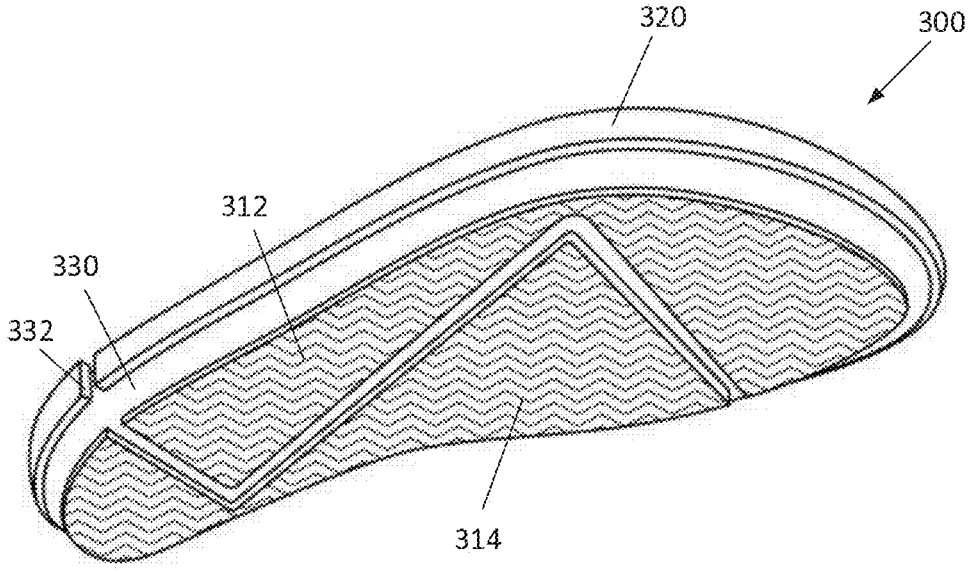
FIG. 37 is a bottom view of the article shown in FIG. 33, showing the article in an expanded configuration with midsole member stretched out in response to a lateral force applied to the article.

FIGS. 36 and 37 are bottom views of article 300, with FIG. 36 showing a view of article 300 in a relaxed configuration and FIG. 37 showing a view of article 300 in an expanded configuration with midsole element 330 stretched out in response to a lateral force applied to article 300.

Figure 38:
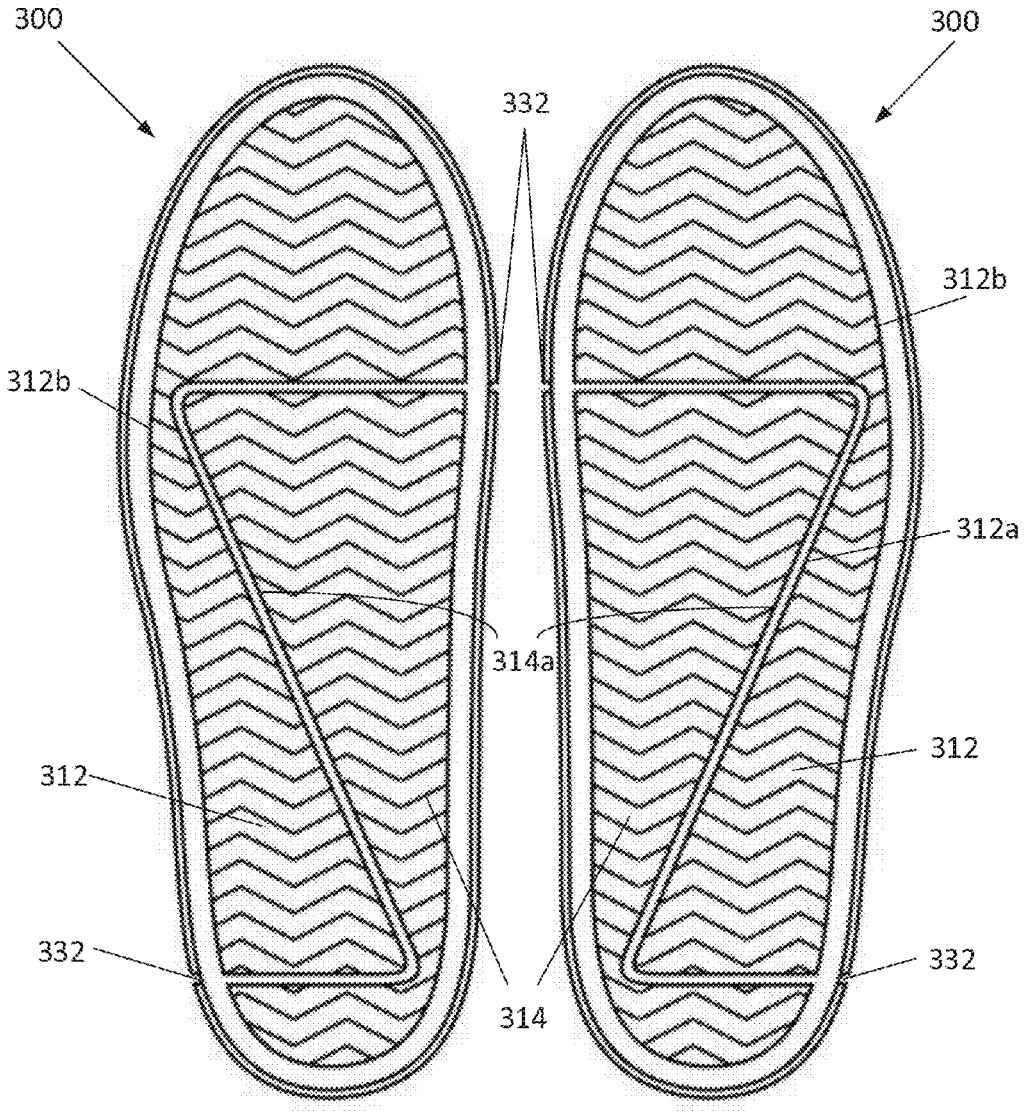
FIG. 38 illustrates a bottom view of the article shown in FIG. 33.
Figure 39:
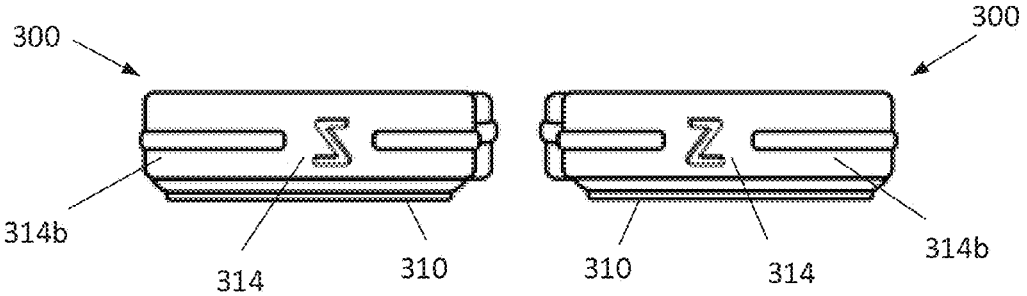
FIG. 39 illustrates a back view of the article shown in FIG. 33.
Figure 40:
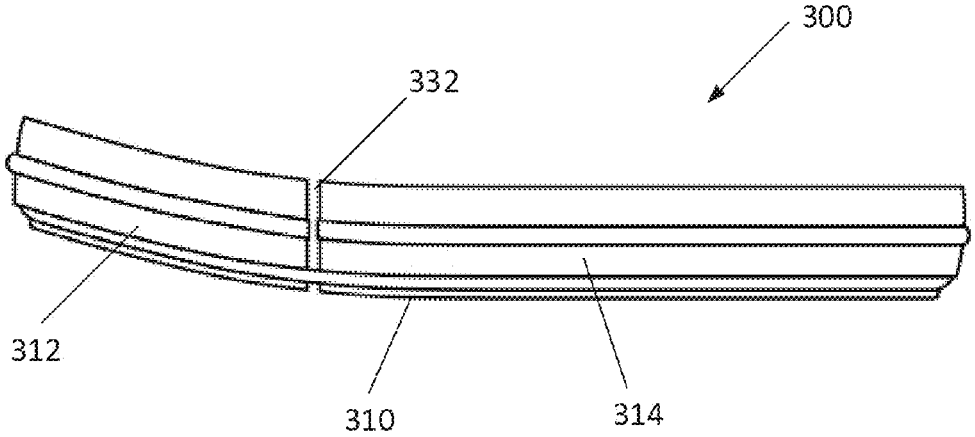
FIG. 40 illustrates a medial view of the right outsole of the article shown in FIG. 33.
Figure 41:
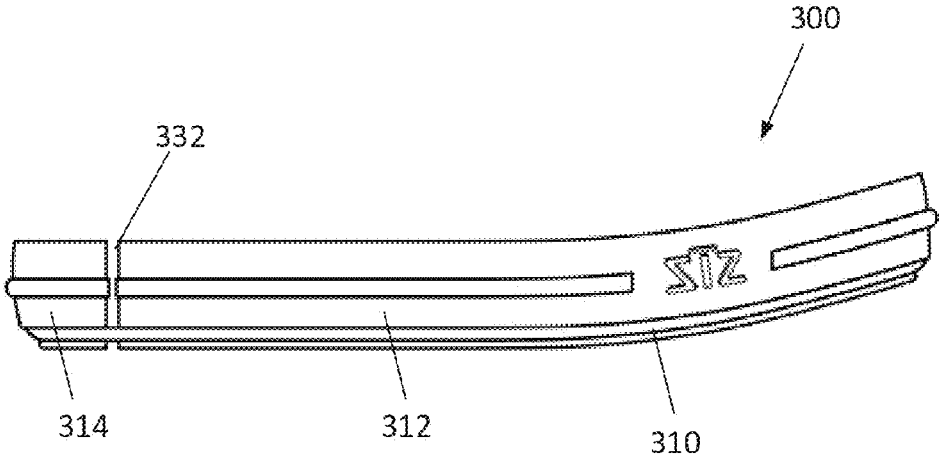
FIG. 41 illustrates a lateral view of the right outsole of the article shown in FIG. 33.

FIGS. 38-41 show additional views of article 300. FIG. 38 illustrates a bottom view of a pair of outsoles 310 that include two outsole members 312, 314. Outsole members 312, 314 have respective inner surfaces 312*a*, 314*a* and perimeter surfaces 312*b*, 314*b*. The inner surface of outsole member 312 faces the inner surface of outsole member 314, while the perimeter surface of each outsole member is a surface at the perimeter of the respective outsole 310 that generally defines the perimeter of article 300. FIG. 39 illustrates a back view, which reflects only a portion of the perimeter surfaces 314*b* on both outsole members 10. FIGS. 40 and 41 illustrate medial and lateral views, respectively, of the right outsole 310.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A method of forming an article of footwear comprising:

forming at least two outsole members, each outsole member comprising a top surface, an inner surface, and a perimeter surface;

positioning the at least two outsole members such that respective inner surfaces face each other and the respective perimeter surfaces collectively define a perimeter of the article; and flexibly coupling the at least two outsole members together such that the article can expand from a relaxed configuration to an expanded configuration, wherein in the expanded configuration the inner surfaces of adjacent outsole members are further apart than in the relaxed configuration, wherein the act of flexibly coupling the at least two outsole members comprises securing a flexible layer to the top surfaces of the at least two outsole members to secure adjacent inner surfaces of respective outsole members to one another so that the at least two outsole members are positioned so that the inner surfaces of respective outsole members collectively define a Z shape, wherein the Z shape is defined by a pair of parallel facing surfaces in a heel region and a forefoot region and a diagonally extending portion that interconnects the parallel areas and extends from a medial side to a lateral side of the article, the parallel facing surfaces being arranged perpendicularly to a longitudinal axis of the article.

2. The method of claim 1, wherein the forming of the at least two outsole members comprises forming a first outsole member, a second outsole member, a third outsole member, and a fourth outsole member, and wherein the flexible layer is secured to the first, second, third, and fourth outsole members with the first outsole member disposed in the heel region, the second outsole member disposed in the forefoot region, and the third outsole member and the fourth outsole member disposed between the first outsole member and the second outsole member.

3. The method of claim 1, wherein the flexible layer is formed of a different material from that of the at least two outsole members, the material of the flexible layer having a greater flexibility than that of the at least two outsole members.

4. The method of claim 1, wherein the Z-shape is curved at areas where the diagonally extending portion interconnects the parallel areas.

5. The method of claim 1, wherein the at least two outsole members further comprise side walls that extend upwardly from respective top surfaces of the at least two outsole members.

6. An article of footwear comprising:

an outsole member consisting of a first outsole member and a second outsole member, the first outsole member having a first upper surface, a first perimeter surface, and a first inner surface, the second outsole member having a second upper surface, a second perimeter surface, and a second inner surface; and at least one flex member secured to the first outsole member and the second outsole member, the at least one flex member having sufficient flexibility to permit the first outsole member to move relative to the second outsole member, wherein the first and second inner surfaces face each other and form pair of parallel facing surfaces in a heel region and a forefoot region and a diagonally extending portion that interconnects the parallel areas and extends from a medial side to a lateral side of the article.

7. The article of claim 6, wherein the pair of parallel facing surfaces are perpendicular to a longitudinal axis of the article.

8. The article of claim 7, wherein the first and second inner surfaces collectively define a Z shape.

9. The article of claim 6, wherein intersecting areas of the diagonally extending portion and the parallel areas are curved.

10. The article of claim 6, wherein the first outsole member comprises a first side wall that extends upwardly at the first perimeter surface and the second outsole member comprises a second side wall that extends upwardly at the second perimeter surface.

11. The article of claim 6, wherein the parallel areas are offset from a centerline that extends from the lateral side to the medial side of the article of footwear and bisects the article of footwear.

12. The article of claim 8, wherein the Z-shape is curved at areas where the diagonally extending portion interconnects the parallel areas.

13. The article of claim 8, wherein the Z-shape is offset relative to a longitudinal axis of the article.

* * * * *